US010072904B2

(12) United States Patent
Binns

(10) Patent No.: US 10,072,904 B2
(45) **Date of Patent: *Sep. 11, 2018**

(54) RATCHET BELT LOCKING SYSTEM FOR HANDGUNS AND LONG GUNS

(71) Applicant: Morgan S. Binns, Merritt Island, FL (US)

(72) Inventor: Morgan S. Binns, Merritt Island, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/618,891

(22) Filed: Jun. 9, 2017

(65) Prior Publication Data

US 2017/0276448 A1 Sep. 28, 2017

Related U.S. Application Data

(62) Division of application No. 14/920,132, filed on Oct. 22, 2015, now Pat. No. 9,677,835.

(51) Int. Cl.

| | |
|---|---|
| ***F41A 17/54*** | (2006.01) |
| ***F41A 17/38*** | (2006.01) |
| ***F41A 17/00*** | (2006.01) |
| ***E05B 73/00*** | (2006.01) |

(52) U.S. Cl.

CPC ..... *F41A 17/54* (2013.01); *E05B 73/0005* (2013.01); *F41A 17/00* (2013.01); *F41A 17/38* (2013.01)

(58) Field of Classification Search

CPC ..... F41A 17/00; F41A 17/34; F41A 17/38; E05B 73/00; E05B 73/0005; E05B 73/02

USPC ..... 42/70.01, 70.02, 70.11; 70/58, 461, 70/DIG. 9

See application file for complete search history.

(56) References Cited

U.S. PATENT DOCUMENTS

| | | | | |
|---|---|---|---|---|
| 557,522 | A | 3/1896 | Blake | |
| 2,983,132 | A | 5/1961 | Falk | |
| 3,018,576 | A | 1/1962 | Riechers | |
| 3,664,163 | A | 5/1972 | Foote | |
| 3,720,014 | A | 3/1973 | Goodrich | |
| 3,857,491 | A | 12/1974 | Townsend | |
| 4,461,385 | A | 7/1984 | Clouser | |
| 4,494,391 | A | 1/1985 | Solow | |
| 4,509,281 | A | 4/1985 | Dreiling et al. | |
| 4,528,765 | A * | 7/1985 | Johnson | F41A 17/44 42/70.05 |

(Continued)

OTHER PUBLICATIONS

AR15 Locking Wall Mount, Quick Release, M4 Safe, AR15 lock, http://arma15.com/products, retrieved on Apr. 25, 2016, 6 pages.

*Primary Examiner* — Bret Hayes
(74) *Attorney, Agent, or Firm* — Brian S. Steinberger; Law Offices of Brian S. Steinberger, P.A.

(57) ABSTRACT

Devices, apparatus, systems and methods for locking ratchet belts about handguns and long guns with a ratchet belt and locking box. An embodiment can remove the working magazine from pistols and long guns replacing it with a non-working magazine that is locked onto the firearm. Another embodiment locks the trigger of handgun and long gun firearms. Another embodiment locks the firearm to support surfaces such as a wall, and the like. A still another embodiment can lock and prevent the pull handle of a shot gun from being pumped. Embodiments can be used alone or in combination so that handguns and long guns are locked and prevented from being discharged.

20 Claims, 18 Drawing Sheets

(56) References Cited

U.S. PATENT DOCUMENTS

| | | | | |
|---|---|---|---|---|
| 4,776,471 | A | 10/1988 | Elkins | |
| 4,934,083 | A | 6/1990 | Smith | |
| 5,016,377 | A | 5/1991 | Gunning | |
| 5,138,786 | A | 8/1992 | Fischer | |
| 5,261,177 | A | 11/1993 | Armstrong | |
| 5,475,993 | A | 12/1995 | Kuo | |
| 5,535,537 | A | 7/1996 | Avganim | |
| 5,544,505 | A | 8/1996 | McIntosh | |
| 5,987,796 | A | 11/1999 | Brooks | |
| 6,044,669 | A | 4/2000 | Levi | |
| 6,330,815 | B1 | 12/2001 | Duncan | |
| 6,427,497 | B1 | 8/2002 | Mossberg | |
| 6,684,667 | B2 | 2/2004 | Young | |
| 8,020,737 | B2 | 9/2011 | Sweeney | |
| 9,677,835 | B1 * | 6/2017 | Binns | F41A 17/54 |
| 2002/0162265 | A1 | 11/2002 | Abad | |
| 2006/0130541 | A1 | 7/2006 | Tollefson | |
| 2006/0288625 | A1 | 12/2006 | Williams | |
| 2008/0066504 | A1 | 3/2008 | Matsushita | |
| 2008/0178509 | A1 | 7/2008 | Pintar et al. | |
| 2016/0333607 | A1 | 11/2016 | Cagan | |

* cited by examiner

RATCHET BELT LOCKING SYSTEM FOR HANDGUNS AND LONG GUNS

This application is a Divisional patent application of U.S. patent application Ser. No. 14/920,132 filed Oct. 22, 2015, now U.S. Pat. No. 9,677,835, which is incorporated by reference in its' entirety.

FIELD OF THE INVENTION

This invention relates to firearms and, in particular, to devices, apparatus, systems, and methods for locking and preventing handgun and long gun firearms from being able to discharge.

BACKGROUND AND PRIOR ART

Millions of persons own firearms that are considered valuable and potentially dangerous when in the wrong hands. These firearms are usually stored in homes or on private property where access to individuals other than the owner becomes a problem.

Owners of firearms should be concerned that their weapons are safely stored to eliminate the possibility of inadvertent or intentional use that is improper or unauthorized. For example, children shoot themselves or each other; impulsive users of guns during stress or in the heat of domestic squabbles results in tragedies; troubled or mentally unbalanced individuals are found responsible for mass killings, and outright theft of weapons causes economic loss.

In 2011, the state of Florida enacted Florida Statute 790.174 entitled, "Safe storage of firearms required," to address a growing concern for weapons or firearms accessible to minors (children). The statute states in part—

"(1) A person who stores or leaves, on a premise under his or her control, a loaded firearm, . . . and who knows or reasonably should know that a minor is likely to gain access to the firearm without the lawful permission of the minor's parent or the person having charge of the minor, or without the supervision required by law, shall keep the firearm in a securely locked box or container or in a location which a reasonable person would believe to be secure or shall secure it with a trigger lock, except when the person is carrying the firearm . . . .

(2) It is a misdemeanor of the second degree, . . . if a person violates subsection (1) by failing to store or leave a firearm in the required manner and as a result thereof a minor gains access to the firearm, without the lawful permission of the minor's parent or the person having charge of the minor, and possesses or exhibits it, without the supervision required by law: (a) in a public place; or (b) in a rude, careless, angry, or threatening manner . . . . This subsection does not apply if the minor obtains the firearm as a result of an unlawful entry by any person.

(3) As used in this act, the term "minor" means any person under the age of 16."

The Florida statute 790.174 is one example of legislative recognition of the potential danger of firearms in the wrong hands. The further statutory requirement of locked storage or a trigger lock encourages the manufacture, sale and use of locking devices for the safe storage of firearms.

A number of such devices are shown in the following United States Patents.

U.S. Pat. No. 557,522 to Blake issued Mar. 31, 1896, shows a padlock with a rigid hasp or flexible chain hasp and a number of notches or holes in a key made to correspond with a number of tumblers in a locking mechanism.

U.S. Pat. No. 3,018,576 to Riechers issued Jan. 30, 1962, shows a rectangular-shaped device that is locked onto the firearm making it impossible to load shells or cartridges into the firearms.

U.S. Pat. No. 3,857,491 to Townsend et al issued Dec. 31, 1974, describes a vehicle mounted gun rack with key operated lock for operating a slidable C-shaped clamp mechanism to lock the stock portion of the gun to the rack.

U.S. Pat. No. 4,776,471 to Elkins issued Oct. 11, 1988, shows a gun rack for a vehicle or wall with upwardly opening cradles within which a gun can be supported and a restraining latch that holds the gun in the cradle in a manner which children find difficult to open. The cradle design prevents a firearm from being inadvertently bumped, jarred or otherwise removed from the cradle. There is no provision for a locking mechanism.

U.S. Pat. No. 5,138,786 to Fischer issued Aug. 18, 1992, discloses a wall mountable safety guard for a rifle, shotgun or handgun consists of thick steel plate housing hinged with side flaps and tongue that is designed to be burglar proof. The steel plate housing encloses a trigger guard for the weapon and employs a combination lock or padlock.

U.S. Pat. No. 5,475,993 to Kuo issued Dec. 19, 1995, discloses a locking device with links that do not form an outwardly direct acute angle that is easily broken, for securing objects of regular or irregular shape. Kuo does not teach or suggest locking a trigger or magazine chamber of a firearm.

U.S. Pat. No. 5,544,505 to McIntosh et al. issued Aug. 13, 1996, shows a lock bracket in two parts held together by a hinge preferably offset to one side; the two parts come together as a shackle, each part overlapping and cooperating to receive a padlock. The lock bracket encloses objects to be secured, such as gates, bicycles to bike racks and the like.

U.S. Pat. No. 6,044,669 to Levi issued Apr. 4, 2000, shows a strap and lock body wherein the strap has a free end portion, a hinge and a lock. The strap is adjustable; the lock engages a series of teeth or a pair of chain-like links located on the strap and prevents withdrawal without disengagement by the user. A pair of hinges allow the hinge portion to lie flush against the lock body and tightly secure an object without rattling or inadvertent disengagement.

U.S. Pat. No. 6,330,815 to Duncan issued Dec. 18, 2001, shows a mounting device for securing a firearm to a support structure such as a motor vehicle. The device has a base with protruding posts to mount a gun, a cover with lock and key to secure the firearm between the base and cover.

U.S. Pat. No. 6,427,497 to Mossberg, Jr. et al. issued Aug. 6, 2002, shows a wall-mounted locking system for firearms that provides a box-like enclosure with a wall-mounted base plate, a breech hook, hinged primary and secondary latch doors and a barrel ring to receive the barrel of the firearm mounted to the wall above the base plate.

What is missing in the prior art is a comprehensive and versatile safety devices that locks both handgun and long gun firearms so that it becomes impossible to discharge the weapon. Thus, it is apparent that a continuing need exists for a safety device for firearms that is useful on a variety of firearms, such as handguns, long guns, is affordable economically, and absolutely prevents the discharge of a firearm.

SUMMARY OF THE INVENTION

A primary objective of the present invention is to provide devices, apparatus, systems, and methods for locking and preventing both handgun and long gun firearms from being able to discharge.

A secondary objective of the present invention is to provide devices, apparatus, systems, and methods for locking a firearm that is simpler, compact and easy to manufacture.

A third objective of the present invention is to provide devices, apparatus, systems, and methods for locking a firearm that removes the working magazine from both handguns and long guns that use magazines, and replaces the working magazine with a non-working magazine that is locked onto the weapon.

A fourth objective of the present invention is to provide devices, apparatus, systems, and methods for locking the trigger of both handgun and long gun firearms in a non-fire position.

A fifth objective of the present invention is to provide devices, apparatus, systems, and methods for locking and preventing pump action shot gun from being fired.

A sixth objective of the present invention is to provide methods, systems, apparatus and devices for mounting and locking a firearm onto a stable surface, such as a wall.

In the various embodiments described below, the present invention solves the problem of completely disabling a firearm and accomplishes the above objectives by providing a locking device that can be used as a singular device or in varying multiples on a firearm so that it becomes virtually impossible for the firearm to be discharged.

A first embodiment provides a firearm locking system with a lock housing attached to a ratchet style belt to lock up a non-working magazine in the machine gun or rifle wherein the working magazine has been removed. Not only is there no ammunition in the gun, but the non-working magazine assures that there are no rounds to be discharged.

A second embodiment provides a wall mount for a handgun or a long gun using the lock housing with a detachable mounting device that is attached to a stable surface, such as a wall. The detachable mounting device locks into one end of the lock housing that is opposite to the end having a belt cavity and an attached ratchet belt. The locking system can be rotated in ninety degree increments without changing the orientation of the wall mount device.

A third embodiment provides a separate trigger lock for handguns and long guns.

A fourth embodiment provides a ratchet belt lock for a pump action shot gun.

A fifth embodiment provides for combining two or more ratchet belt locks per firearm to insure that all means for discharging the weapon are disabled or locked.

Further objects and advantages of this invention will be apparent from the following detailed description of preferred embodiments which are illustrated schematically in the accompanying drawings.

DESCRIPTION OF THE PREFERRED EMBODIMENTS

Figure 1:
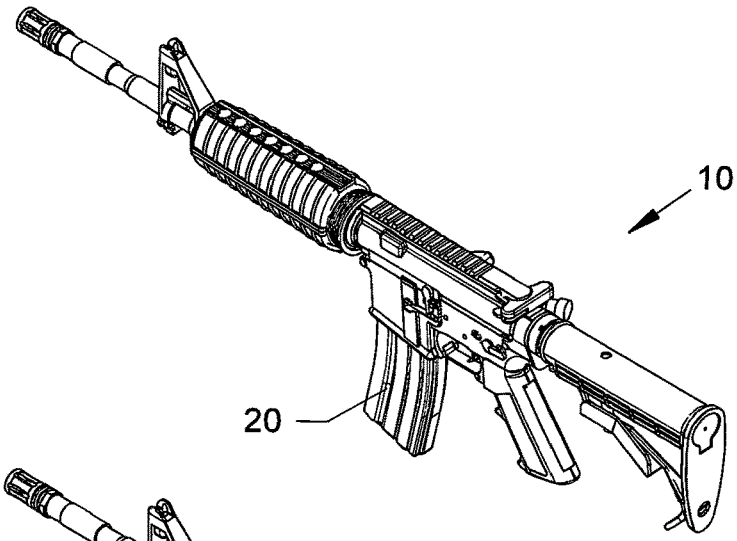
FIG. 1 (PRIOR ART)
FIG. 1 is a front perspective view of an Armalite (AR) style rifle. (Prior Art)

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Listed below are the components of the firearm locking system as shown in FIGS. 1-41:

10 Armalite (AR) style rifle (Prior Art)
20 Rifle magazine (Prior Art)
30 Non-working magazine slide assembly (NWMS)
40 Belt cavity of non-working magazine slide assembly (NWMS)
50 Screw
60 Non-working magazine
70 Nut
80 Lock housing
90 Ratchet belt
100 Lock housing body
110 Lock housing belt cavity
120 Key
130 Mounting device
135 Mounting screw
140 Key lock
150 Mounting device latch cavity (female member)
160 Mounting device latch catch
170 Mounting device latch (male member)
180 Wall
190 Link assembly with ratchet belt catches
200 Link pin
210 Link
220 Flexible link pad
230 Set screw secures link pin
240 Threaded hole in link holds set screw.
250 Link knuckle
260 Link assembly without belt latch catches

270 Flexible lock housing pad
280 Mounting holes in mounting device
290 Ratchet belt latch catches
295 Ratchet belt latch
300 Pistol trigger lock slide assembly
310 Pistol trigger lock
320 Alignment key slide rails for ratchet belt cavity attachment to the non-working magazine slide (NWMS) assembly
330 Alignment slot in trigger lock for ratchet belt slide
340 Alignment slot in rifle magazine for ratchet belt slide
350 Pistol
360 Trigger lock guard posts
370 Shotgun
372 Barrel
374 Pump handle
380 Lock housing assembly with button pad lock
385 Push button lock pad
390 Lock housing assembly with barrel combination lock
395 Barrel combination lock
400 Lock housing assembly with finger print reader lock
405 Finger print reader.

It would be useful to discuss the meanings of some words used herein and their application before discussing the firearm locking system of the present invention.

"Ammunition," "cartridge", "shell" and "round" are used interchangeably to mean a cylindrical, usually metal casing containing the primer and powder charge and bullet for a firearm. Spent cartridge and spent shell includes the cylindrical casing after the bullet is fired therefrom.

"Firearm," "rifle", and "pistol" are used interchangeably to refer to all weapons having either a tubular and/or box style magazine and barrel in which the firing mechanism and grip or stock are located behind the trigger group.

"Hand gun" is used to refer to a firearm designed to be handheld, in either one or both hands. A pistol and a revolver are types of handguns.

"Long gun" is used to refer to the general class of firearms which are generally designed to be fired when the stock is braced against the shoulder of the user. The actual lengths of the barrels of a long gun are subject to various laws in many jurisdictions. Examples of various long guns include, but are not limited to, rifles, shotguns, machine guns, carbines, and the like.

"Shotgun" is used to refer to class of firearms having a pump action with a single barrel above a tube magazine into which shells are inserted. New shells are chambered by pulling a pump handle (fore-end) attached to the tube magazine toward the user, then pushing it back into place to chamber the cartridge.

"Ratchet belt" is used to refer to the elongated strap or belt attached to the lock housing of the present invention. The ratchet has a toothed surface that is shaped to engage a pivoted lever to permit motion in one direction only and to prevent the belt from slipping in a reverse direction.

The directional terms "horizontal," "vertical," "front," "forward," "rear," "rearward," "right," and "left" refer to the firearm when held in the normal firing position. When firing, the rear end of the firearm is close to or in close proximity to the body of the user, while the front end is farthest from the user and the point at which the ammunition exits the firearm.

FIGS. 1-13 illustrate the first embodiment of the present invention wherein a lock housing with an attached ratchet belt locks up the non-working magazine in an AR style rifle.

FIGS. 14-20 show the second embodiment of the present invention wherein the lock housing with an attached ratchet belt and a detachable wall mounting device is used to mount the locked firearm on a stable surface such as a wall.

FIGS. 21A-26 provide detail of the lock housing, attached ratchet belt, locking mechanism and detachable wall mounting device.

FIGS. 27-36 illustrate the third embodiment of the present invention wherein a trigger lock is shown for use on handguns and long guns; only handguns are shown in the figures provided.

Figure 37:
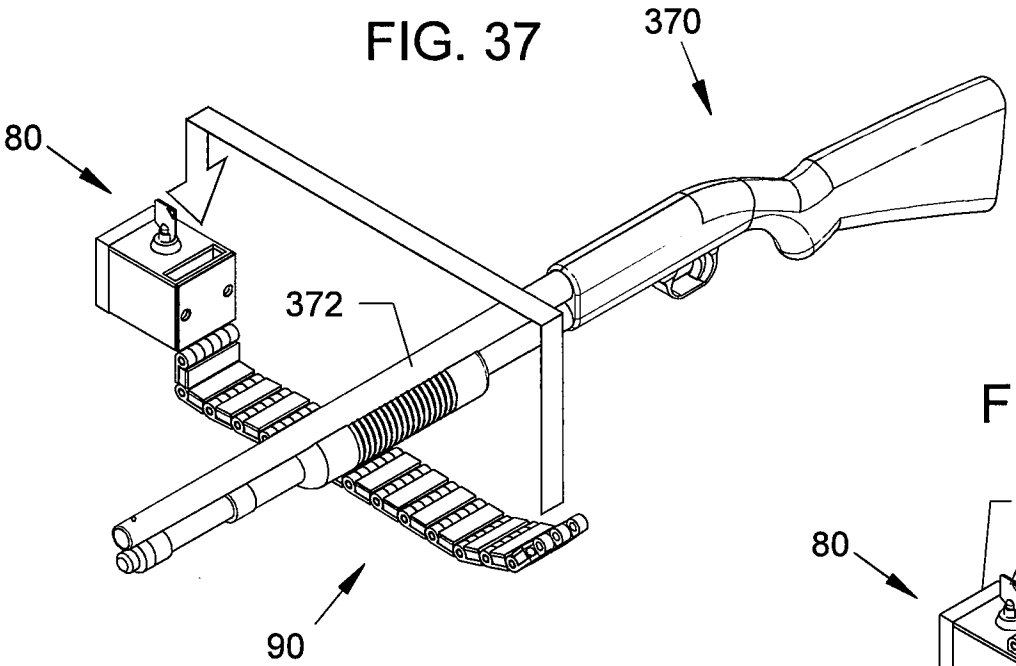
FIG. 37 is a front perspective of a shotgun positioned for the lock housing with attached ratchet belt to wrap around the barrel behind the pump handle of a shotgun. No slide assembly is used in this configuration.
Figure 38:
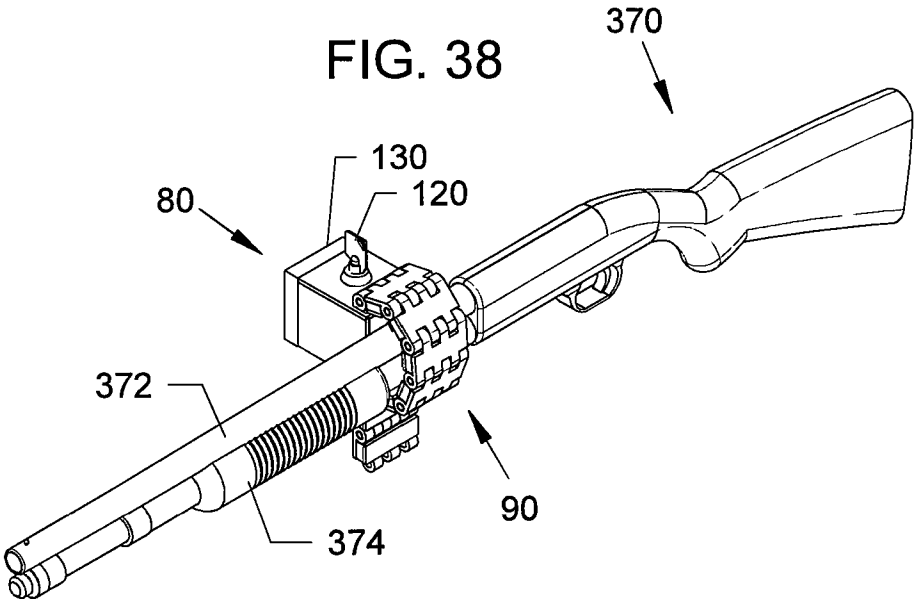
FIG. 38 is a front perspective of a shotgun wherein the lock housing with attached ratchet belt is wrapped around the barrel behind the pump handle of a shotgun and locked. No slide assembly is used in this configuration.

FIGS. 37-38 show the fourth embodiment of the present invention wherein the lock housing with attached ratchet belt is used to lock a pump action shot gun.

Figure 41:
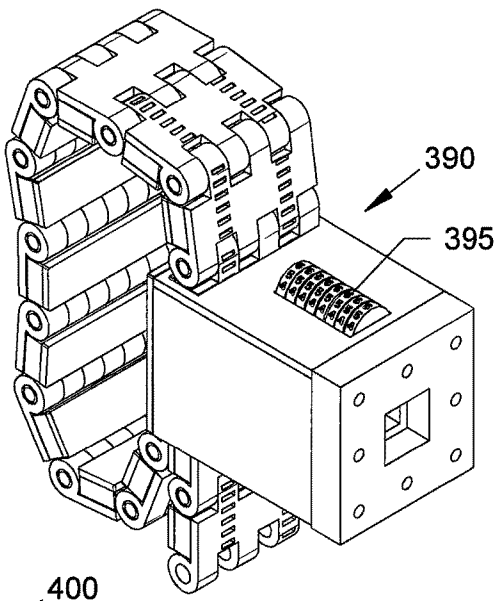
FIG. 41 shows the lock housing of the present invention with a barrel combination lock.
Figure 40:
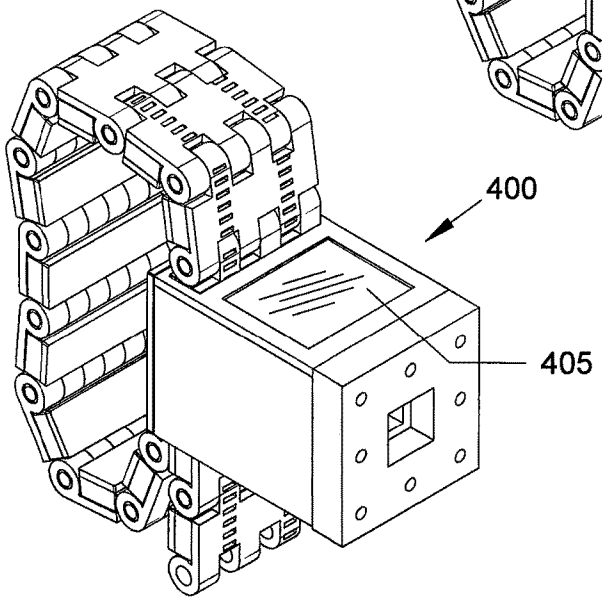
FIG. 40 shows the lock housing of the present invention with a biometric lock, such as a fingerprint reader.
Figure 39:
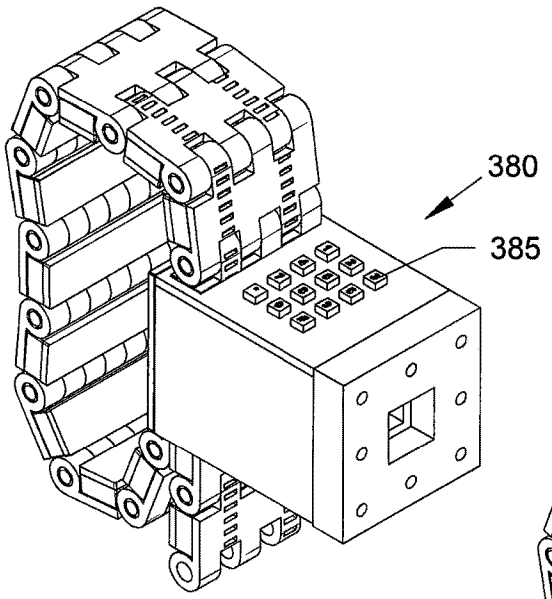
FIG. 39 shows the lock housing of the present invention with a button pad lock.

FIGS. 39-41 show a variety of locks useful in the lock housing of the present invention.

Figure 2:
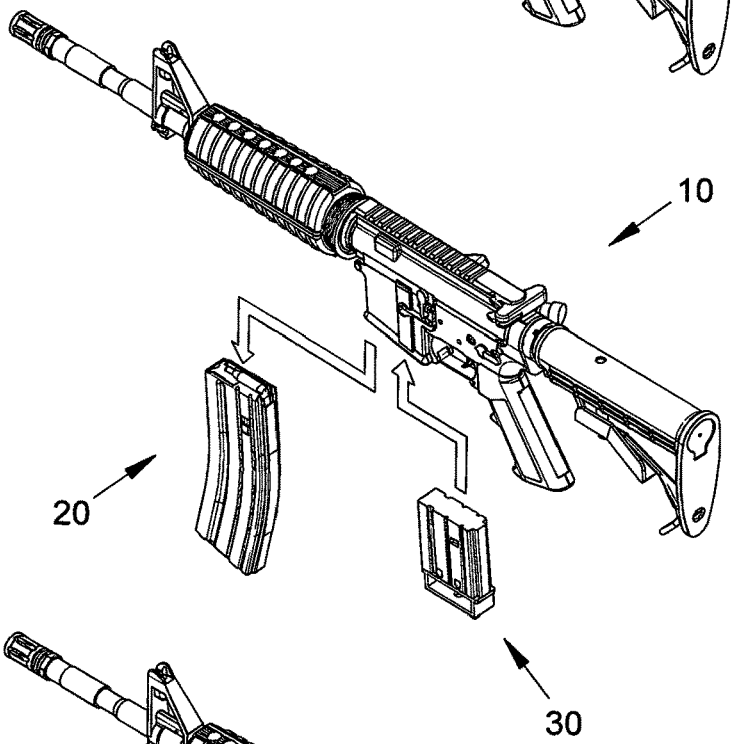
FIG. 2 shows the working magazine removed from the rifle shown in FIG. 1 and a non-working magazine slide assembly (NWMS) of the present invention before it is inserted into the rifle.
Figure 3:
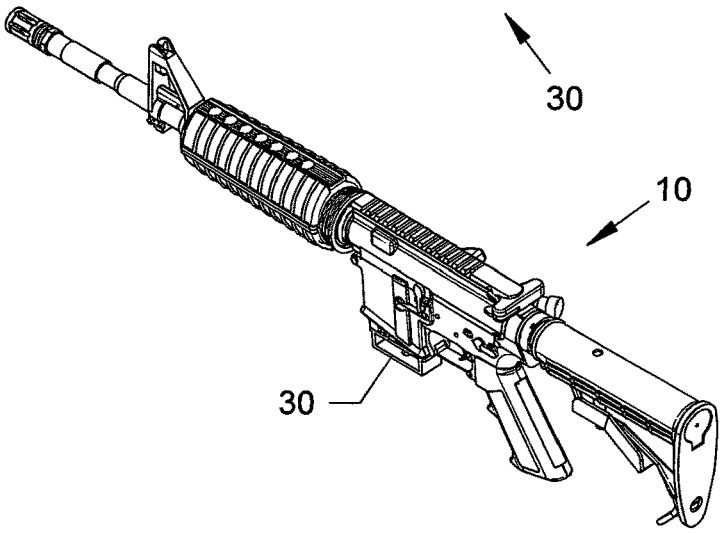
FIG. 3 shows the non-working magazine slide assembly (NWMS) of the present invention after it is inserted into the rifle shown in FIG. 1.

FIG. 1 shows an Armalite (AR) style rifle 10 with an inserted magazine 20 which is known in the Prior Art. FIG. 2 shows the inserted magazine 20 removed from the rifle 10 and a non-working magazine slide assembly (NWMS) 30 of the present invention (such as a solid or hollow structure), before it is inserted into the rifle 10. The insertion of the non-working magazine slide assembly (NWMS) 30 of the present invention as it is shown in FIG. 3 insures that there is no ammunition in the rifle 10 and the firearm cannot be discharged.

Figure 4:
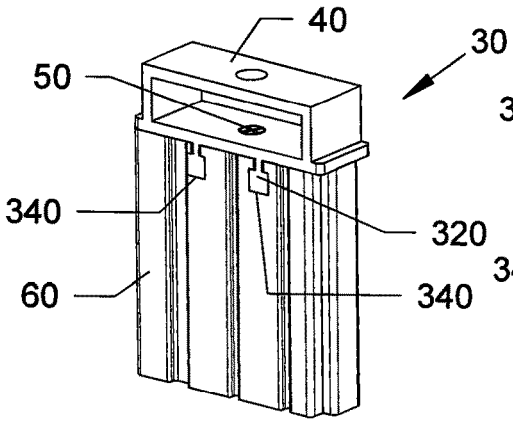
FIG. 4 is a front perspective view of the fully assembled non-working magazine slide assembly (NWMS) of the present invention.
Figure 5:
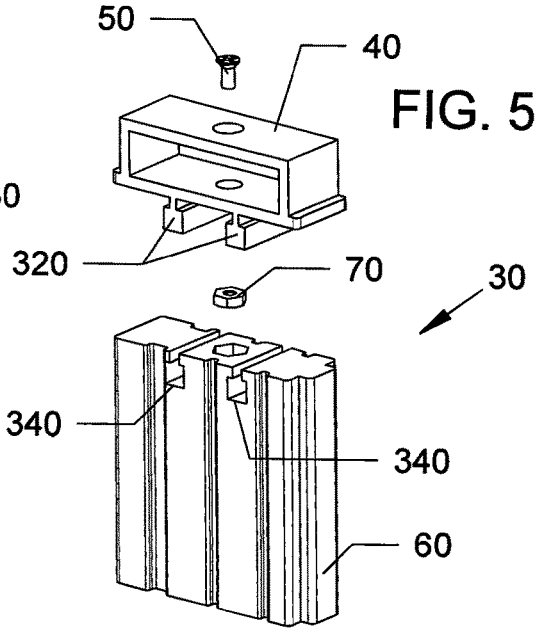
FIG. 5 is an exploded view of the non-working magazine slide assembly (NWMS) of the present invention showing all parts.

FIG. 4 provides a front perspective view of the fully assembled non-working magazine slide assembly (NWMS) 30 of the present invention. The non-working magazine 60 can be made of an epoxy resin and formed by additive manufacturing (or alternatively formed from metal, combinations of metal and plastic and the like), and be a solid block that fits into the magazine of a rifle. On an end of the non-working magazine 60 that is not inserted into the rifle, two alignment slots 340 are formed to receive the alignment key slide rails 320 formed on the underside of the ratchet belt cavity 40 and held in place by a screw 50.

An exploded view of the non-working magazine slide assembly (NWMS) 30 of the present invention shows all parts, including the non-working magazine 60 with a nut 70 centrally positioned between two parallel alignment slots 340 that receive the alignment key slide rails 320 formed on the underside of the ratchet belt cavity 40 and when fully assembled, the ratchet belt cavity 40 is held in place by screw 50.

Figure 6:
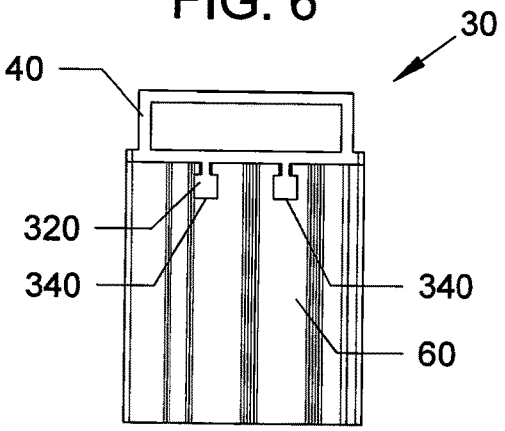
FIG. 6 is a front view of the fully assembled non-working magazine slide assembly (NWMS) of the present invention.
Figure 7:
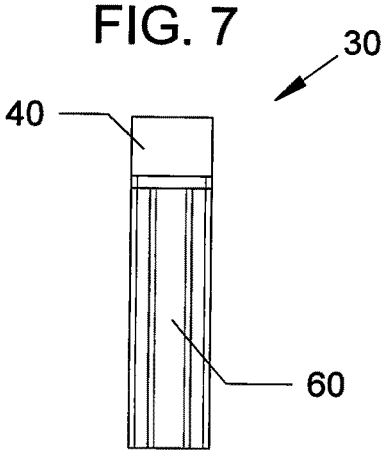
FIG. 7 is a side view of the fully assembled non-working magazine slide assembly (NWMS) of the present invention.

FIG. 6 is a front view of the fully assembled non-working magazine slide assembly (NWMS) 30 of the present invention wherein the non-working magazine 60 with alignment slots 340 are fitted with alignment key slide rails 320 integrally attached to the ratchet belt cavity 40. FIG. 7 provides a side view of the fully assembled non-working magazine slide assembly (NWMS) 30 of the present invention showing the non-working magazine 60 attached to the ratchet belt cavity 40.

Figure 8:
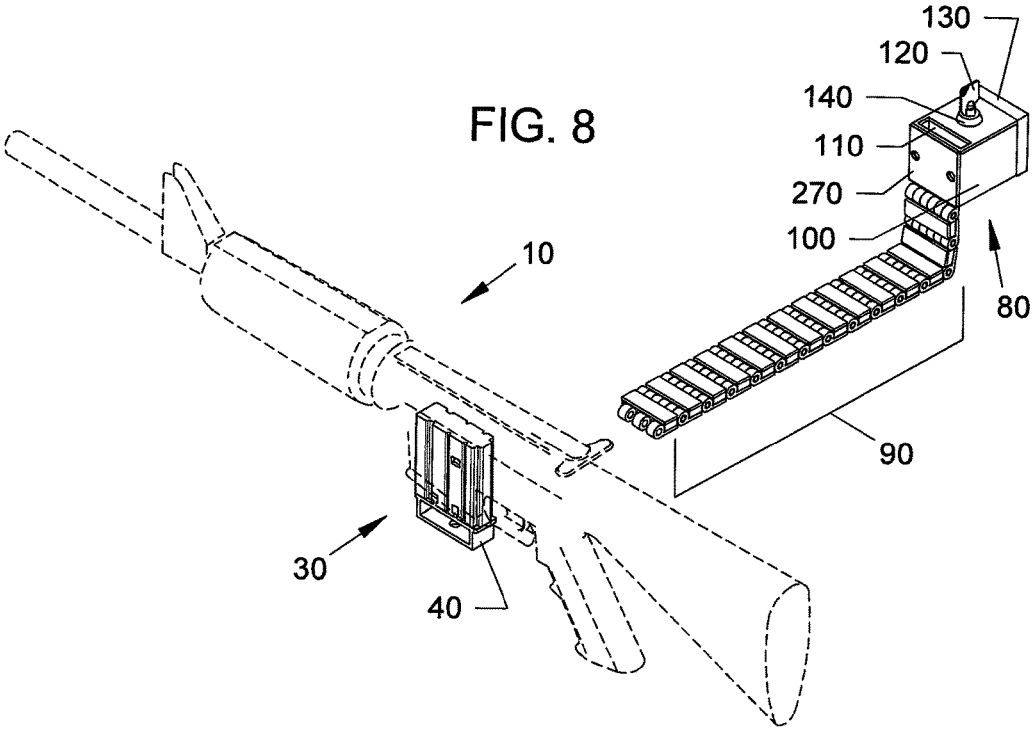
FIG. 8 is a front perspective view of the non-working magazine slide assembly (NWMS) of the present invention inserted into an AR style rifle and the lock housing with attached ratchet belt in position before it is fed into the non-working magazine slide assembly (NWMS).

FIG. 8 is a front perspective view of the non-working magazine slide assembly (NWMS) 30 of the present invention inserted into an AR style rifle 10 and the lock housing 80 with attached ratchet belt 90 in a position to be fed into the non-working magazine slide assembly (NWMS). The lock housing body 100 has a lock housing belt cavity 110, a key 120, a key lock 140 for locking and unlocking various parts, a mounting device 130 for mounting the locked firearm to a stable surface, such as a wall, and a flexible lock housing pad 270 on the side of the lock body 100 that is opposite the mounting device 130.

Figure 9:
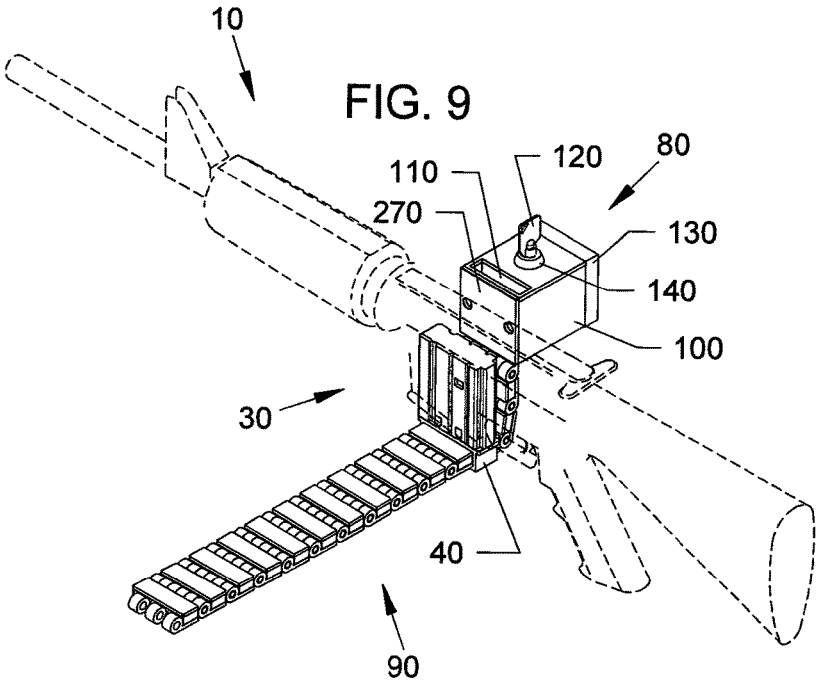
FIG. 9 shows the lock housing with attached ratchet belt after the ratchet belt is inserted into the non-working magazine slide assembly (NWMS).

FIG. 9 shows the lock housing 80 with all of its incorporated features, namely, a lock housing body 100, a lock housing belt cavity 110, a key 120, key lock 140, a mounting device 130, and a flexible lock housing pad 270 attached to ratchet belt 90 after the ratchet belt 90 is fully inserted into the ratchet belt cavity 40 of the non-working magazine slide assembly (NWMS) 30. The ratchet belt 90 can be pulled into selected length positions.

Figure 10:
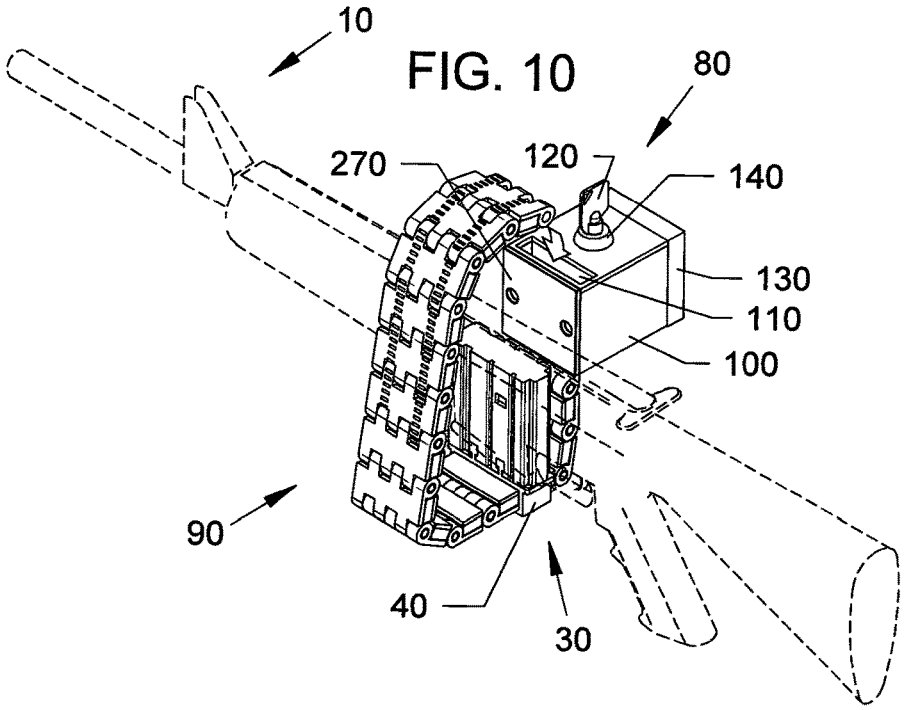
FIG. 10 is a front perspective view of the lock housing with attached ratchet belt wherein the belt is in position to be inserted into the belt cavity of the lock housing.

FIG. 10 is a front perspective view of the lock housing 80 with lock housing body 100, a lock housing belt cavity 110, a key 120, key lock 140, a mounting device 130, and a flexible lock housing pad 270 attached to ratchet belt 90 after the ratchet belt 90 is inserted into the ratchet belt cavity 40 of the non-working magazine slide assembly (NWMS) 30 and wrapped around the rifle 10 with the unattached end of the ratchet belt in position to be inserted into the belt cavity 110 of the lock housing 80.

Figure 11:
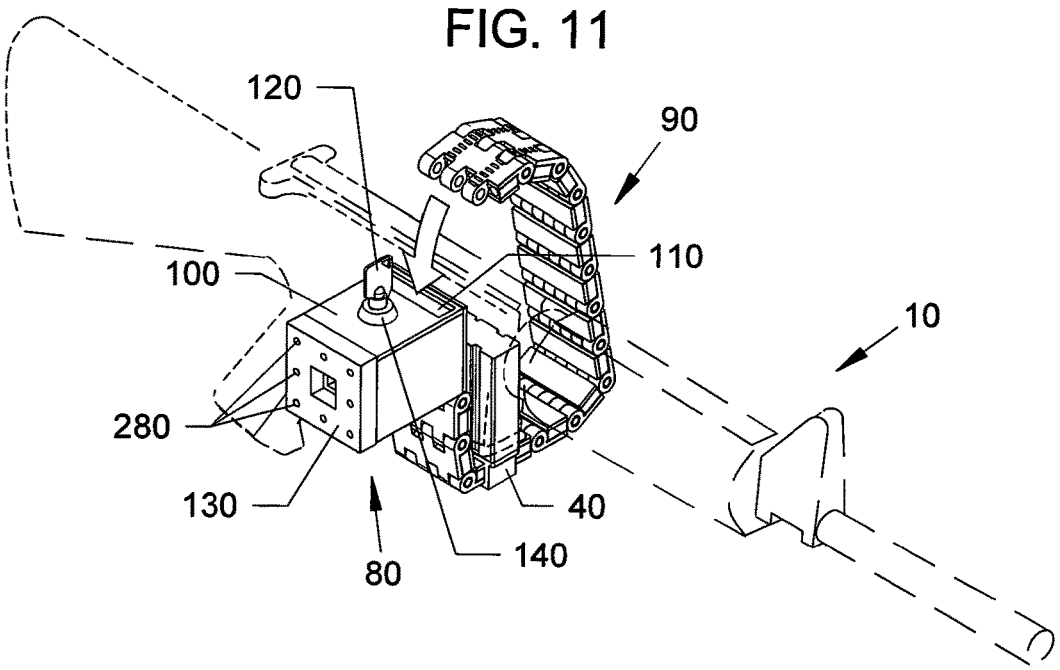
FIG. 11 is a rear perspective view of the lock housing with attached ratchet belt showing the ratchet belt in position to be inserted into the belt cavity located on the end opposite to the wall mount attachment of the lock housing.

FIG. 11 provides a rear perspective view what is shown in FIG. 10. The flexible lock housing pad 270 is not visible in this view; instead the detachable wall-mount device 130 is shown and the mounting holes 280 in the mounting device can be seen. The ratchet belt 90 is in position to be inserted into the belt cavity 110 located on the end opposite to the wall mount attachment 130 of the lock housing 80.

Figure 12:
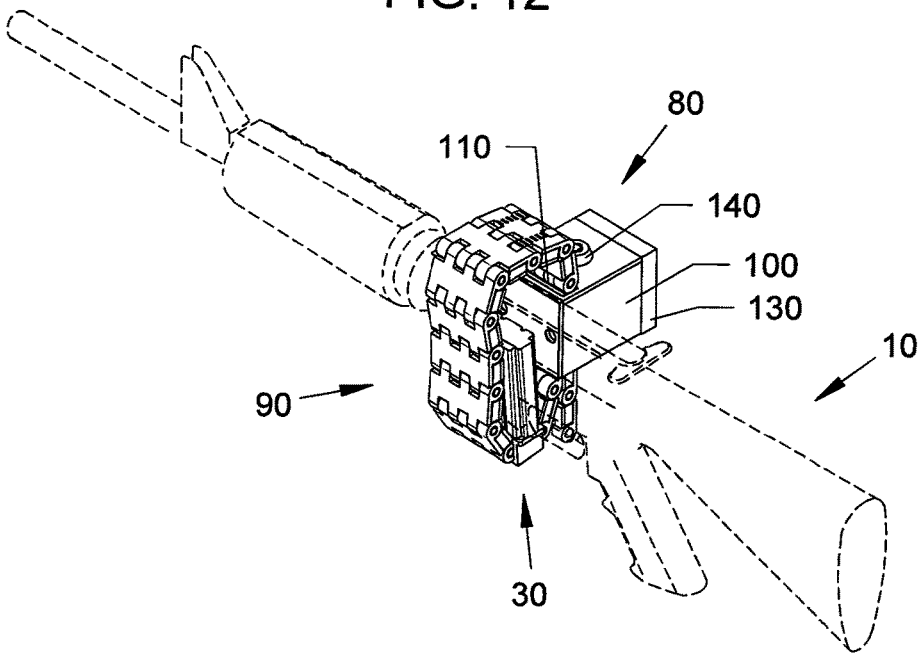
FIG. 12 is a front perspective view of the lock housing with attached ratchet belt wherein the belt is snug around the rifle and pulled through the belt cavity of the lock housing which secures the non-working magazine slide assembly (NWMS) to the rifle and lock housing.
Figure 13:
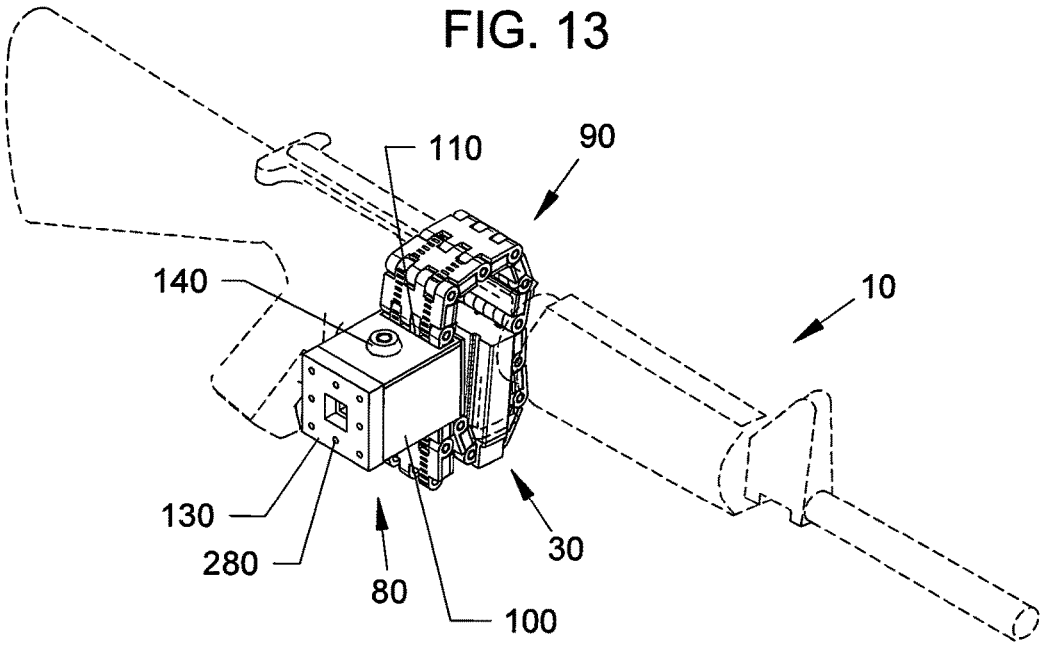
FIG. 13 is a rear perspective view of the lock housing with attached ratchet belt wherein the belt is snug around the rifle and pulled through the belt cavity of the lock housing which secures the non-working magazine slide assembly (NWMS) to the rifle and lock housing. The rear perspective view also shows the wall mount attachment of the lock housing.

Referring now to FIGS. 12 and 13 wherein FIG. 12 is a front perspective view and FIG. 13 is a rear perspective view of the lock housing 80 with lock housing body 100 attached to ratchet belt 90 wherein the ratchet belt 90 is snug around the rifle 10 and pulled through the belt cavity 110 of the lock housing 80 which secures the non-working magazine slide assembly (NWMS) 30 to the rifle 10 and lock housing 80 with a locking means or key lock 140. The rear perspective view in FIG. 13 also shows the wall mount attachment 130 and the mounting holes 280 in the mounting device.

FIGS. 14-20 illustrate the locking and unlocking features of the ratchet belt from the lock body housing and the locking and unlocking of the mounting device that is detachable from the lock housing body. Both the ratchet belt and the detachable wall-mount device can be inserted into their respective cavities regardless of the position of the key.

Figure 14:
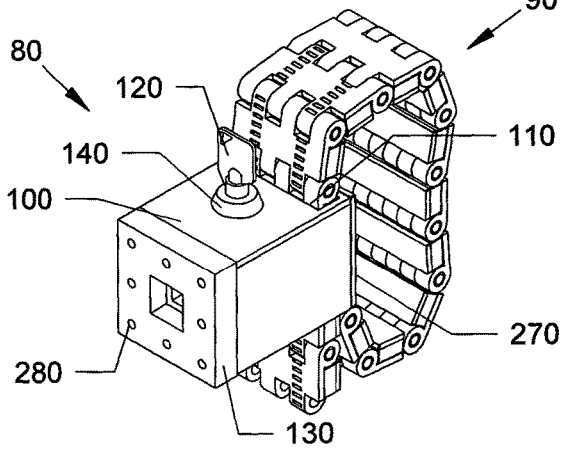
FIG. 14 is a rear perspective view of the lock housing with attached ratchet belt wherein the belt is pulled through the belt cavity of the lock housing with the key in the "all locked" position; the rear perspective view also shows the wall mount attachment of the lock housing.

FIG. 14 is a rear perspective view of the lock housing 80 with ratchet belt 90 attached to flexible lock housing pad 270 wherein the belt 90 is pulled through the belt cavity of the lock housing 110 and locked and the wall mount attachment 130 with mounting holes 280 is also locked onto the housing body 100 when the key 120 in key lock 140 is in the "all locked" position.

Figure 15:
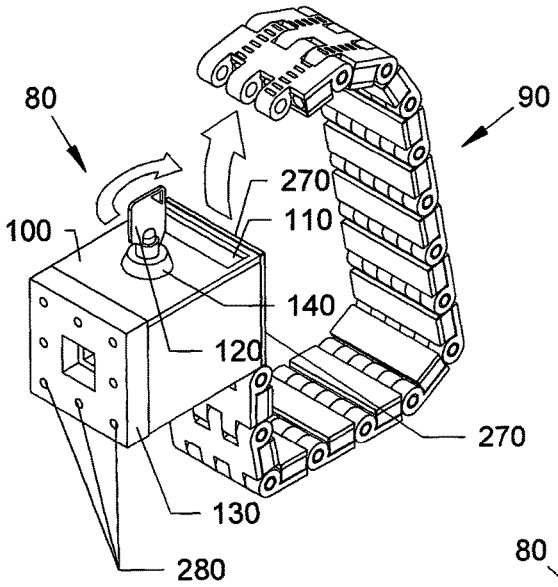
FIG. 15 is a rear perspective view of the lock housing with attached ratchet belt wherein the belt is released from the belt cavity of the lock housing with the key in the "belt unlocked" position; the rear perspective view also shows the wall mount attachment of the lock housing.
Figure 16:
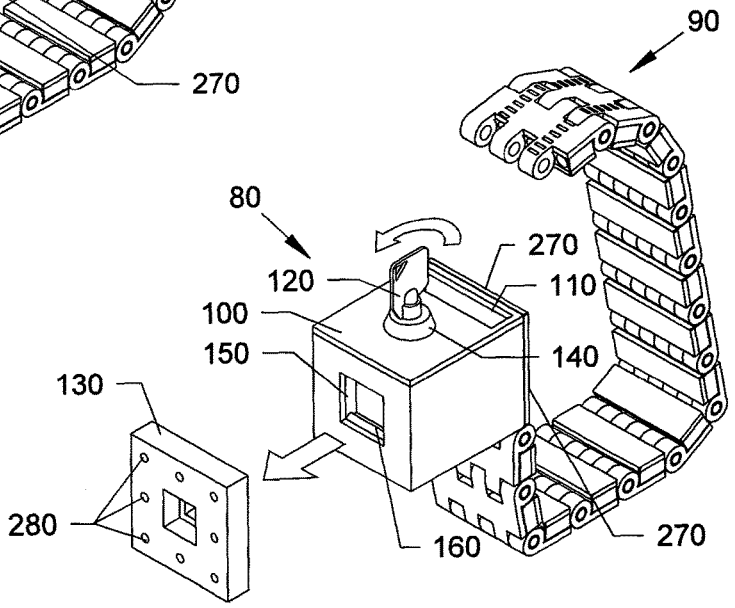
FIG. 16 is a rear perspective view of the lock housing with attached ratchet belt wherein the belt is released from the belt cavity of the lock housing with the key in the "wall-mount unlocked" position showing the wall mount attachment disengaged from the lock housing.

FIG. 15 is the same view as FIG. 14 with the key 120 rotated clockwise in the "belt unlocked" position and the ratchet belt 90 is released; the wall mount attachment 130 of the lock housing 80 is still attached to lock housing body 100. FIG. 16 is also the same view as FIG. 14 with the key 120 rotated counter-clockwise wherein the ratchet belt 90 is released from the belt cavity 110 of the lock housing body 100 with the key in the "wall-mount unlocked" position showing the wall mount attachment 130 disengaged from the lock housing body 100.

Figure 17:
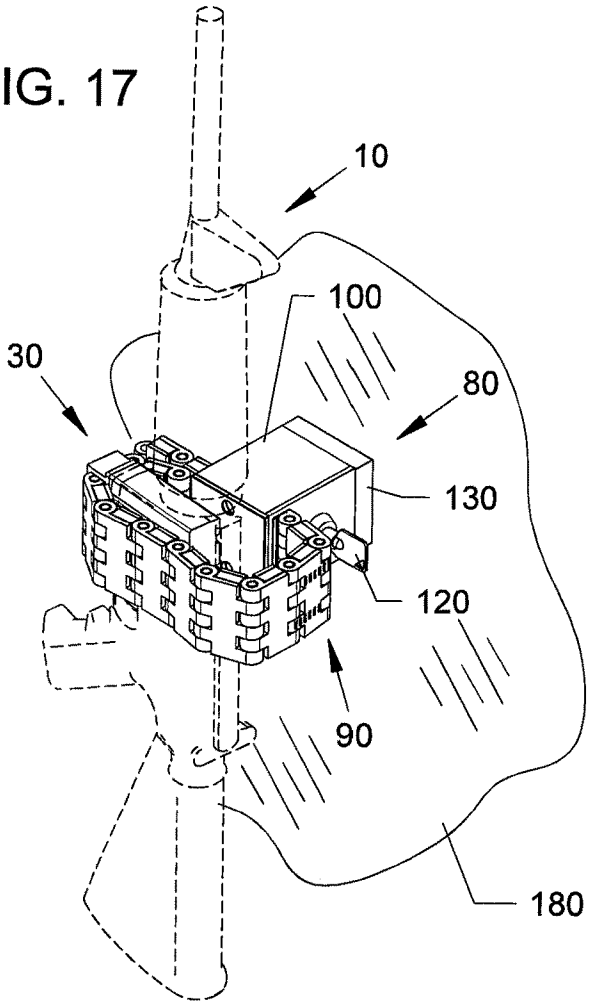
FIG. 17 shows a wall-mounted long gun or rifle in a vertical configuration using the lock housing with a detachable mounting device that is attached to a stable surface, such as a wall; the firearm locking system has a lock housing attached to a ratchet style belt that locks up a non-working magazine in a rifle wherein the working magazine has been removed.

FIG. 17 shows a wall-mounted long gun or rifle 10 in a vertical configuration using the lock housing 80 wherein the lock housing body 100 has a detachable mounting device 130 that is attached to a stable surface, such as a wall 180; the key 120 is in the "all lock" position, thus locking the ratchet belt 90, non-working magazine slide (NWMS) 30 assembly and the mounting device 130 onto a rifle 10 that is held vertically on a wall 180.

Figure 18:
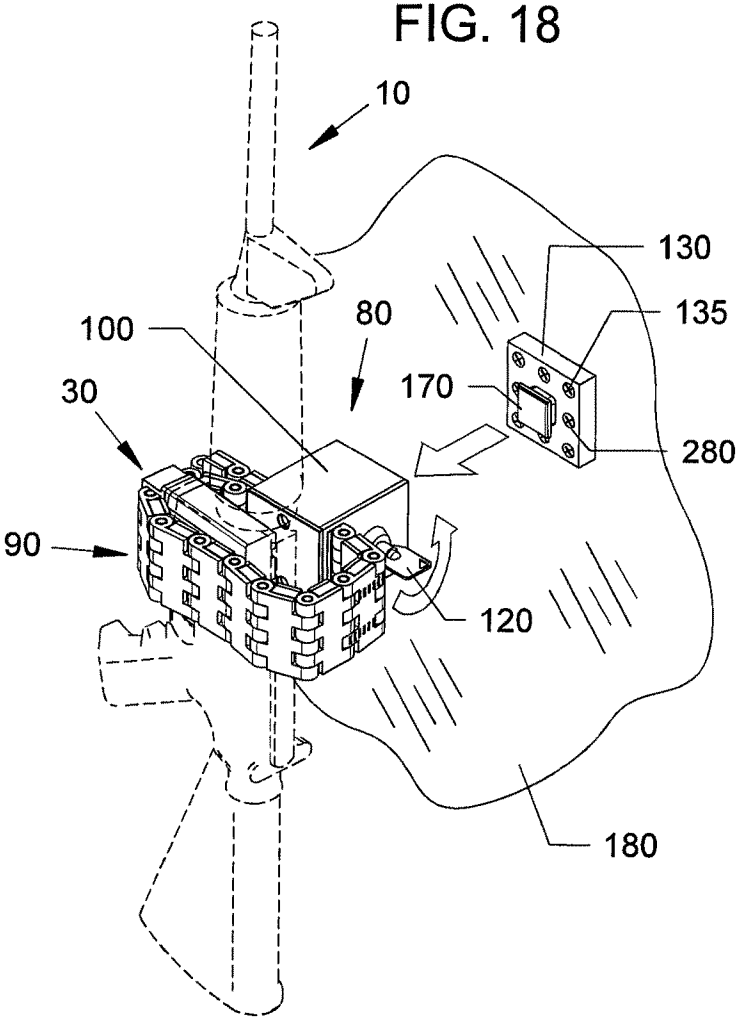
FIG. 18 shows a wall-mounted long gun or rifle in a vertical configuration wherein the lock housing is detached from the mounting device that is attached to a stable surface, such as a wall; the firearm locking system has a lock housing attached to a ratchet style belt that locks up a non-working magazine in a rifle wherein the working magazine has been removed.

FIG. 18 shows the same configuration as FIG. 17 except that the key 120 is turned counter-clockwise to the "wall-mount unlocked" position which releases the locked rifle from the wall mount 130 having mounting holes 280, mounting screws 135 and a mounting device latch 170 from the lock housing body 100. The wall mount 130 remains on the stable surface such as a wall 180.

Figure 19:
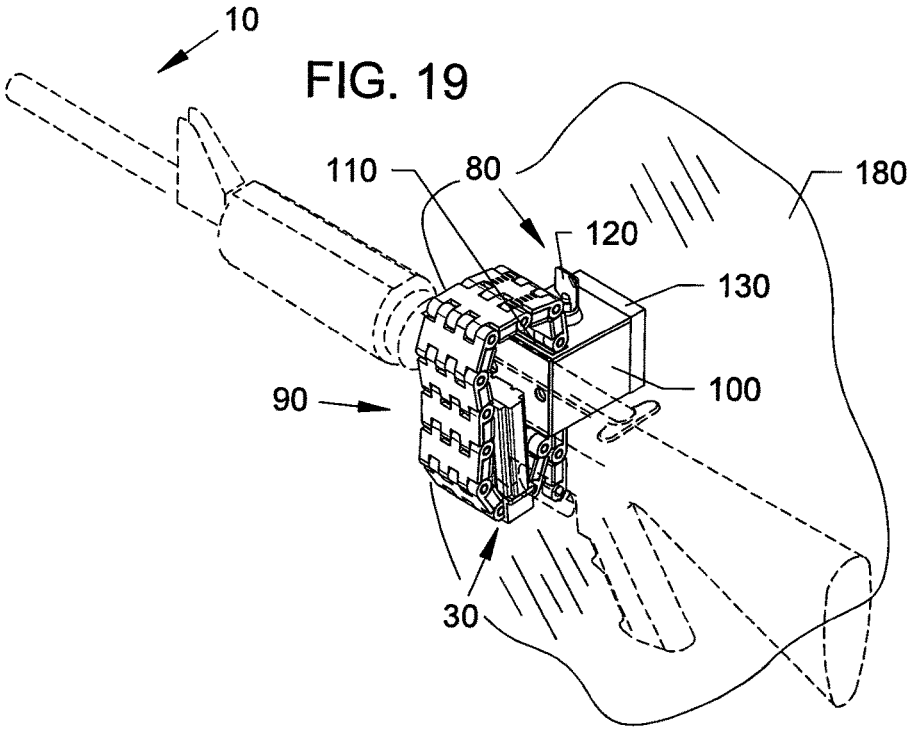
FIG. 19 shows a wall-mounted long gun or rifle in a horizontal configuration using the lock housing with a detachable mounting device that is attached to a stable surface, such as a wall; the firearm locking system has a lock housing attached to a ratchet style belt that locks up a non-working magazine in a rifle wherein the working magazine has been removed.

FIG. 19 shows a wall-mounted long gun or rifle 10 in a horizontal configuration using the lock housing 80 with a detachable mounting device 130 that is attached to a stable surface, such as a wall 180; the ratchet style belt 90 wraps around a non-working magazine slide (NSWM) 30 assembly and is fed through the belt cavity 110 of the lock housing body 100 in a rifle 10. The key 120 is in the "all lock" position, thus locking the ratchet belt 90, non-working magazine slide (NWMS) 30 assembly and the mounting device 130 onto a rifle 10 that is being held horizontally on a wall 180.

Figure 20:
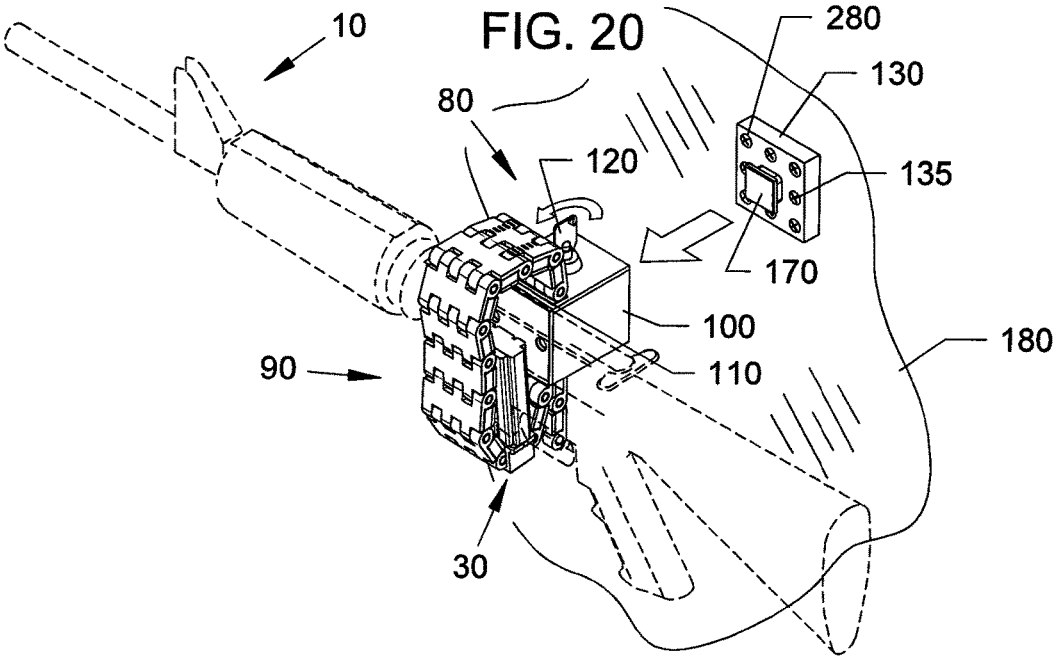
FIG. 20 shows a wall-mounted long gun or rifle in a horizontal configuration wherein the lock housing is detached from the mounting device that is attached to a stable surface, such as a wall; the firearm locking system has a lock housing attached to a ratchet style belt that locks up a non-working magazine in a rifle wherein the working magazine has been removed.

FIG. 20 shows the same horizontal configuration as shown in FIG. 19 except that the key 120 is turned counter-clockwise to the "wall-mount unlocked" position which releases the locked firearm from the wall mount 130 having mounting holes 280, mounting screws 135 and a mounting device latch 170 from the lock housing body 100. The wall mount 130 remains on the stable surface such as a wall 180.

The wall-mount attachment of the present invention separates from the lock housing assembly when unlocked with a key and mounts to a wall or other secure surface. The wall-mount attachment is also designed such that the firearm stored or mounted with this attachment can be rotated in ninety degree increments without changing the orientation of the wall-mounting device that is attached to a wall or other stable surface.

Although the support surface is described as a wall, any support surface, that is either vertical, horizontal, slanted and the like, can be used. Additionally, the support surface can be inside of a container, such as inside of a lock safe and the like.

Ratchet Belt and Locking Detail.

The universal features in all embodiments of the present invention include the use of the ratchet belt and a locking mechanism.

The operation of the ratchet belt 90 with key lock 140 with belt latch 295, belt latch catches 290 shown in FIGS. 23A-24B, 14-16 can be a ratchet locking system, such as but not limited to the system described in U.S. Pat. No. 6,044,669 to Clark Levi issued Apr. 4, 2000, the teachings of which are incorporated herein by reference.

The operation of the locking mechanism in this invention, using the key lock 140 with wall block latch cavity 150, wall block latch catch 160 and wall block latch 170 shown in FIGS. 15-20, 25-26, it is as explained and described in U.S. Pat. No. 3,018,576 to W. H. Riechers issued Jan. 30, 1962, the teachings of which are incorporated herein by reference.

Figure 21A:
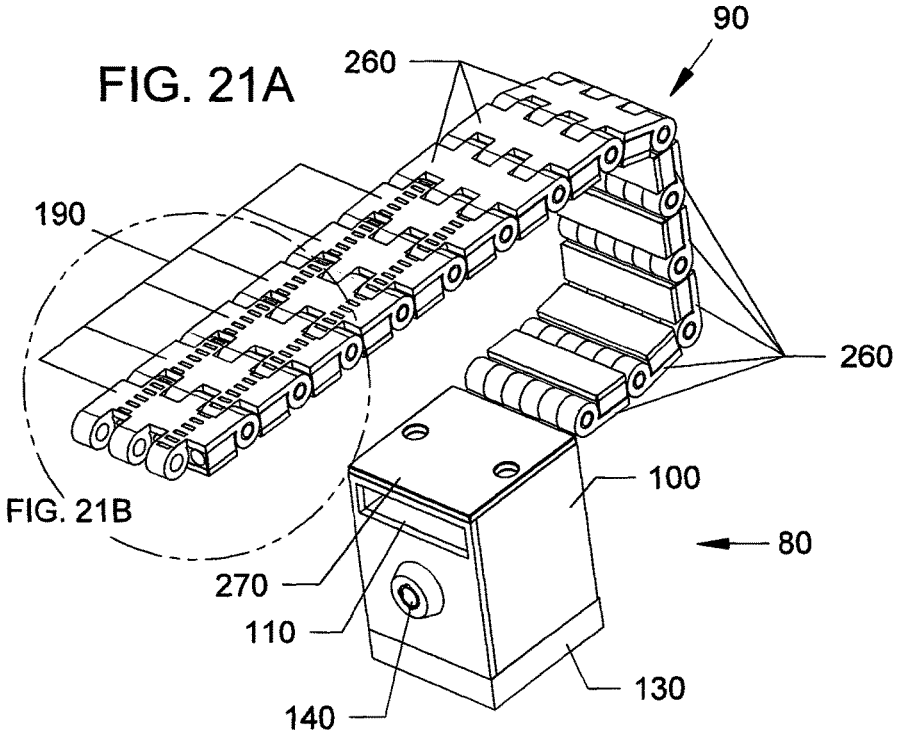
FIG. 21A is a top perspective view of the ratchet belt disengaged from the belt cavity of the lock housing showing the belt links having belt latch catches cut into the links.

FIG. 21A is a top perspective view of the lock housing 80 with an attached mounting device 130, a key lock 140, and a ratchet belt 90 attached to a flexible lock housing pad 270, wherein the ratchet belt 90 is disengaged from the belt cavity 110 of the lock housing body 100 showing the belt links without belt latch catches 260 and belt links with belt latch catches cut into the links 190.

Figure 21B:
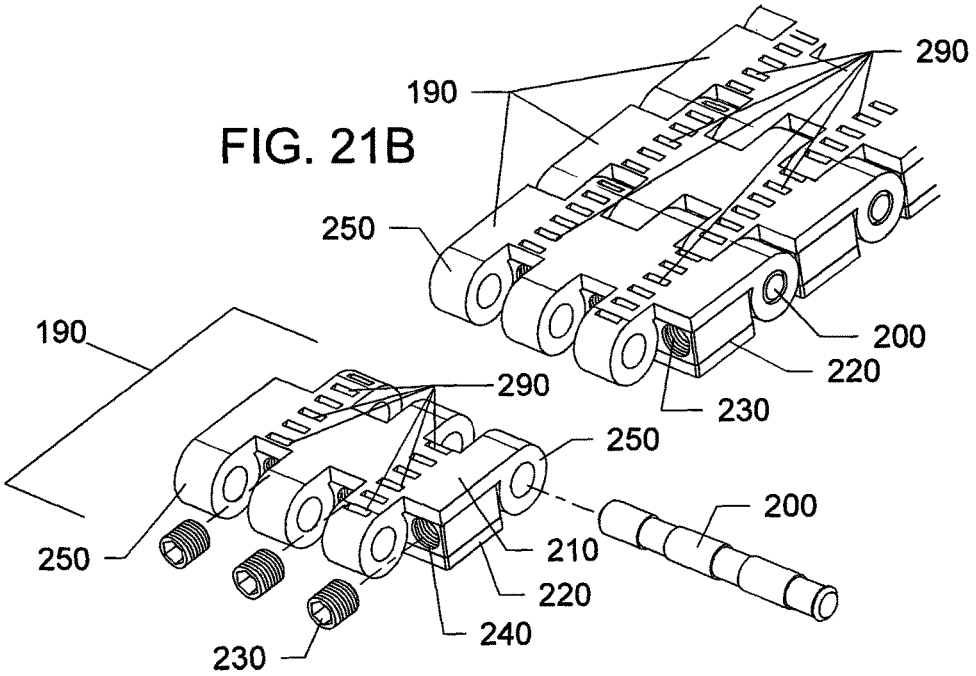
FIG. 21B is an exploded view of the ratchet belt showing how individual links can be removed or added in order to obtain a lock belt length appropriate to the firearm being secured.

FIG. 21B is an exploded view of the ratchet belt with belt latch catches 290 cut into the links 190 showing how individual links 210 can be removed by taking out set screws 230 that secure link pins 200 that are threaded through link knuckles 250 at the joining end of each link 210. Individual links can be added by joining individual links 210 in order to obtain a lock belt length appropriate to the firearm being secured. Each link 210 is designed with identical symmetry and features including multiple knuckles 250 on a horizontal side of the link, a flexible link pad 220 on the underside side of the link, threaded screw holes 240 in link to hold the set screws 230 to secure the link pin 200 that is used to attach the desired number of individual links 210. A preferred embodiment of the lock belt 90 can include a plurality of generally identical segments (of plural link assembly 190).

Figure 22:
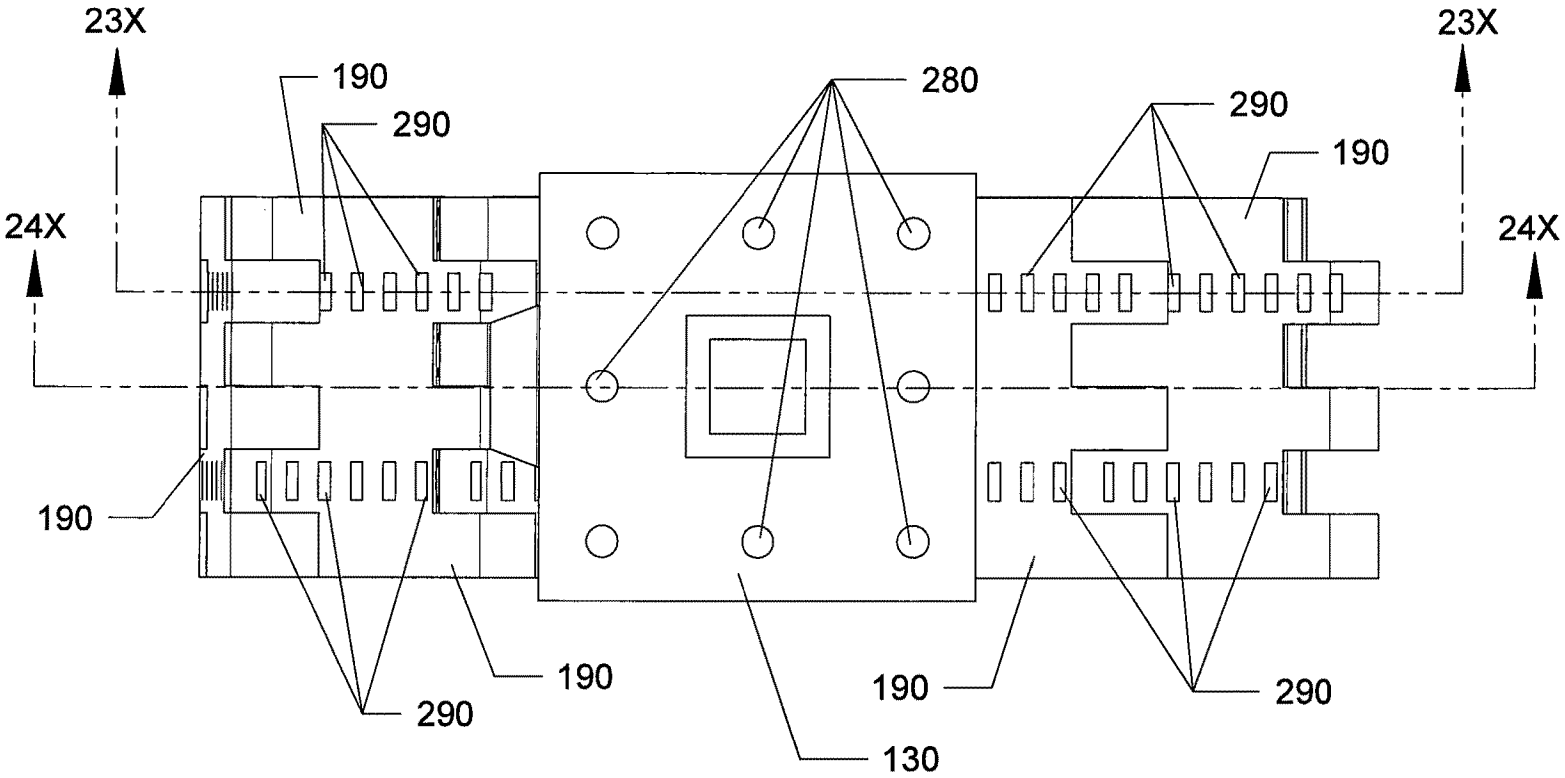
FIG. 22 is a rear view of the firearm locking system with a lock housing attached to a ratchet style belt wherein the belt is pulled through the belt cavity on one end of the lock housing and the wall mount attachment is on the opposite end of the lock housing. Arrows are provided as a guide to the cross-sectional FIGS. 23A and 24A.

FIG. 22 is a rear view of the firearm locking system with a lock housing attached to a ratchet style belt wherein the belt is pulled through the belt cavity on one end of the lock housing and the wall mount attachment is on the opposite end of the lock housing. Arrows are provided as a guide to the cross-sectional FIGS. 23A and 24A.

Figure 23A:
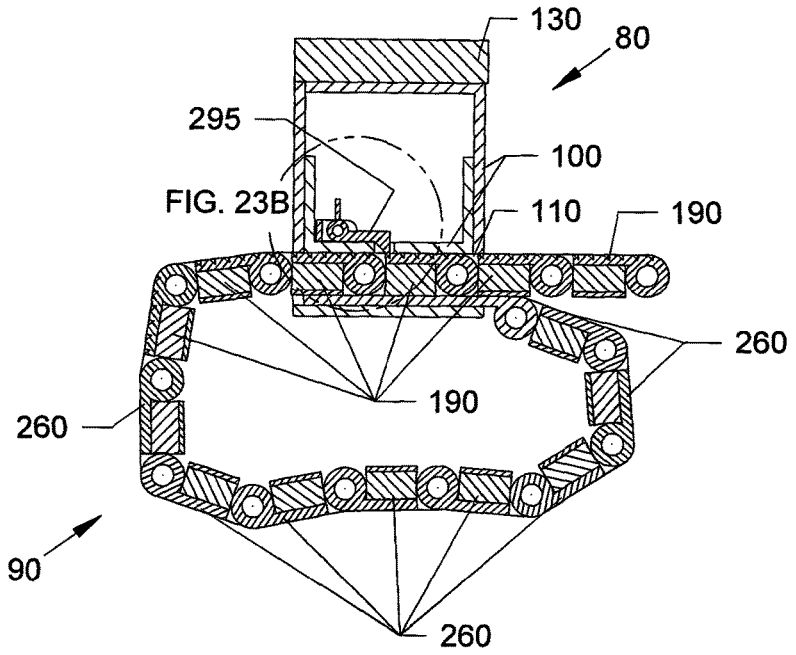
FIG. 23A is a cross-sectional view of the ratchet belt of FIG. 22 along arrow 23X pulled through the belt cavity of the lock housing showing how the belt latch interfaces with the catches on the links of the ratchet belt.
Figure 23B:
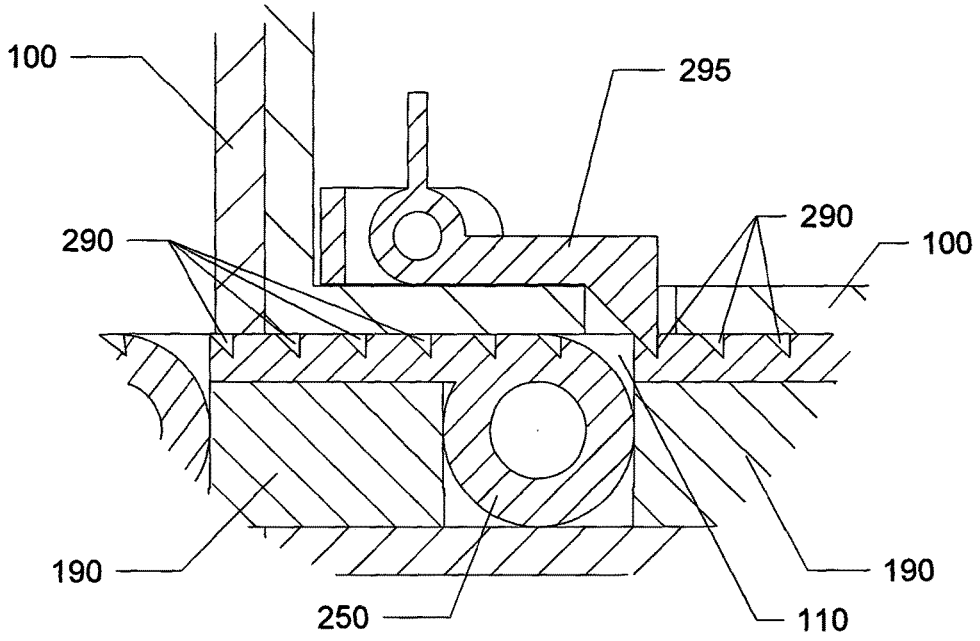
FIG. 23B is an enlarged cross-sectional view of the belt latch interfacing with the series of teeth or catches on the ratchet belt to prevent withdrawal of the belt without disengagement by the user.

FIG. 23A shows a cross-section of the ratchet belt 90 pulled through the belt cavity 110 of the lock housing 80 with a mounting device 130 on the lock housing body 100. The ratchet belt 90 comprises a link assembly without belt latch catches 260 and link assembly with ratchet belt catches 190 on the end that is pulled through the belt cavity 110. This cross-sectional view shows how the ratchet belt latch 295 interfaces with the catches on the links of the ratchet belt. FIG. 23B is an enlarged cross-sectional view of one link assembly with ratchet belt catches 190, link knuckles 250, and the belt latch 295 that is positioned inside the lock housing body 100 adjacent to the lock housing belt cavity 110 and interfaces with the series of teeth or catches 290 on the ratchet belt to prevent withdrawal of the belt without disengagement by the user.

Figure 24A:
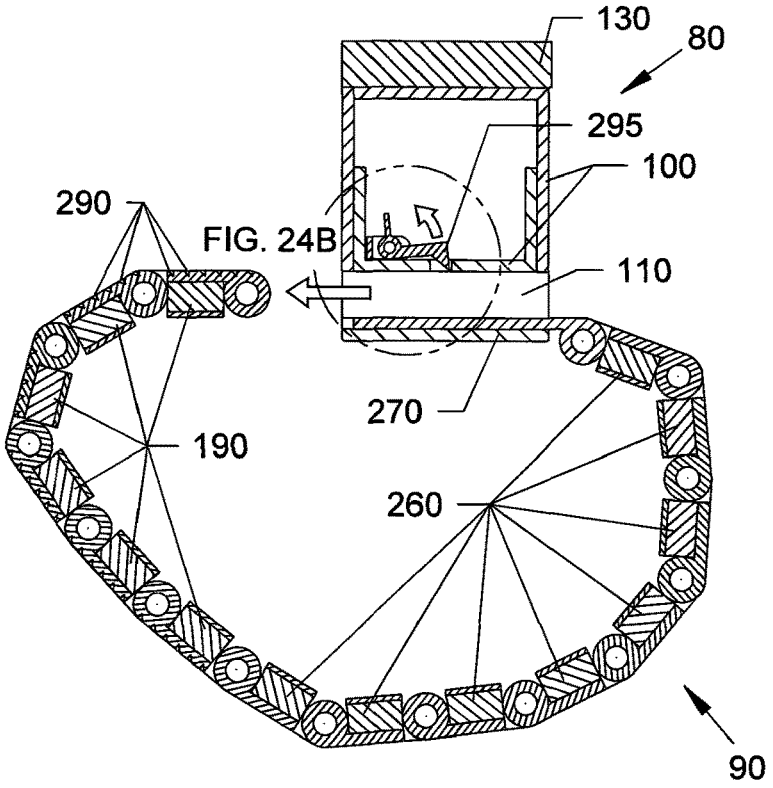
FIG. 24A is a cross-sectional view of the belt latch rotated upward thereby disengaging the catches on the link and allowing the ratchet belt of FIG. 22 along arrow 24X to be removed from the belt cavity of the lock housing.

FIG. 24A is a cross-sectional view similar to the view shown in FIG. 23A, the difference is that the belt latch 295 is rotated upward thereby disengaging the catches 290 on the link assembly with ratchet belt catches 190 and allows the ratchet belt 90 composed of a link assembly with ratchet belt catches 190 and a link assembly without ratchet belt catches 260 to be removed from the belt cavity 110 of the lock housing 80.

Figure 24B:
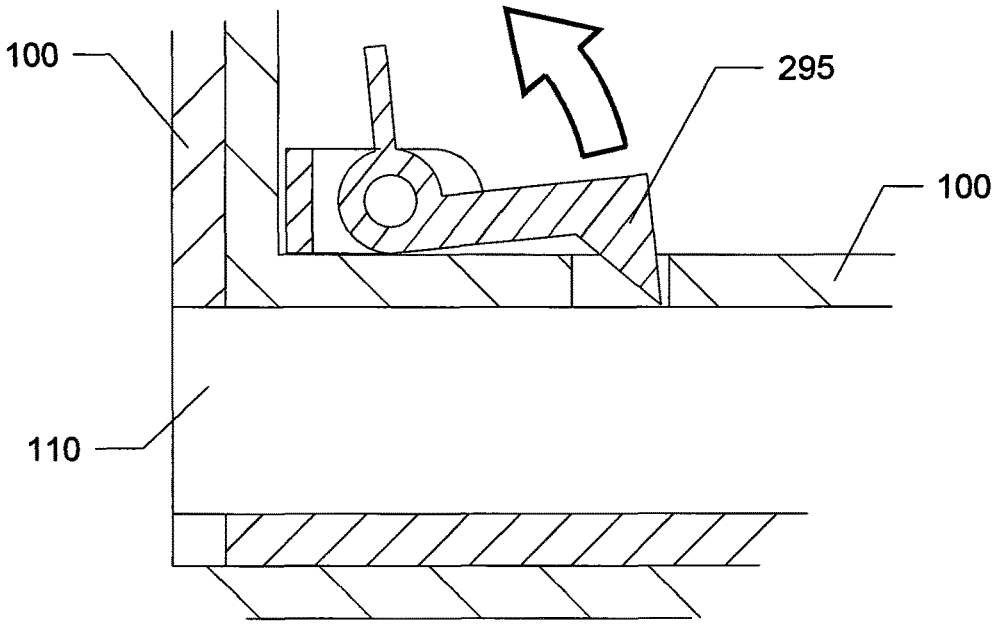
FIG. 24B is an enlarged cross-sectional view of the belt latch when rotated upward thereby disengaging the catches on the link of the ratchet belt.

FIG. 24B is an enlarged cross-sectional view of the belt latch 295 when rotated upward to a position within the lock housing body 100 thereby completely disengaging the catches on the link assembly of the ratchet belt which is no longer in the lock housing belt cavity 110.

Figure 25:
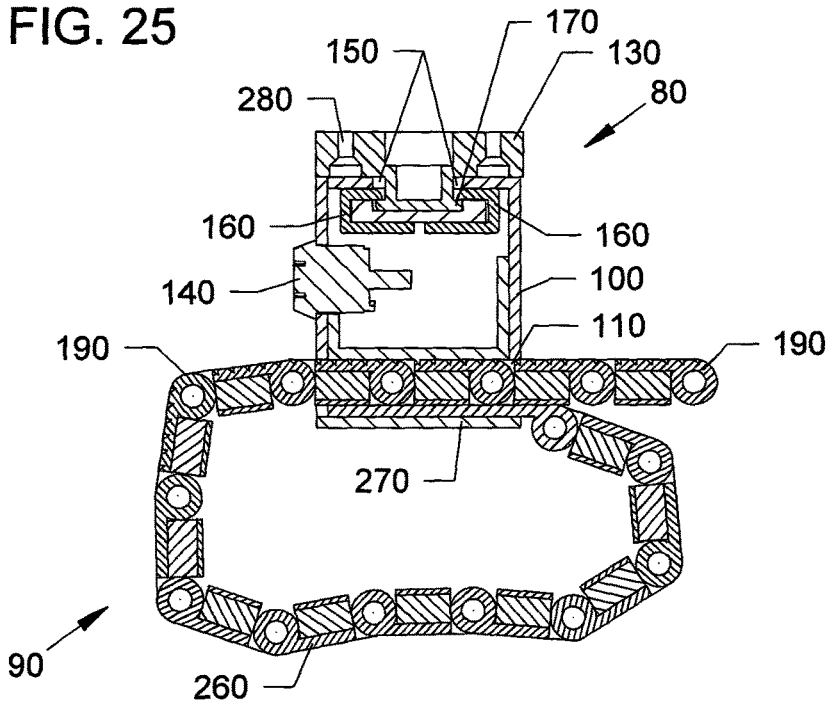
FIG. 25 is a cross-sectional view of the wall mount attachment secured to the lock housing with a closed rectangular clasp holding the enlarged head of a male member of the wall-mount attachment, the key that controls the clasp and the ratchet belt pulled through the belt cavity of the lock housing are also shown.

FIG. 25 is a cross-sectional view of the lock housing 80 with lock housing body 100, a lock housing belt cavity 110, key lock 140, a mounting device 130 with mounting holes 280, and a flexible lock housing pad 270 attached to ratchet belt 90 comprising a link assembly with ratchet belt catches 190 and a link assembly without ratchet belt catches 260 wherein the link assembly with ratchet belt catches 190 is pulled through the belt cavity 110 of the lock housing 80. The wall mount attachment 130 has a mounting device latch 170 known as a male member that fits into a mounting device latch cavity 150 known as a female member located in the top center of the lock housing body 100. The mounting device latch cavity 150 is surrounded by a movable mounting device latch catch 160 that moves in and out around the mounting device latch 170 that is inserted in the female member 150. FIG. 25 shows the mounting device latch catch 160 moved to an inward position from the walls of the lock housing body 100 thus holding the mounting device latch 170 within the mounting device latch cavity 150. The inward and outward movement of the rectangular-shaped, mounting device latch catch 160 is a direct result of turning the key lock 140.

Figure 26:
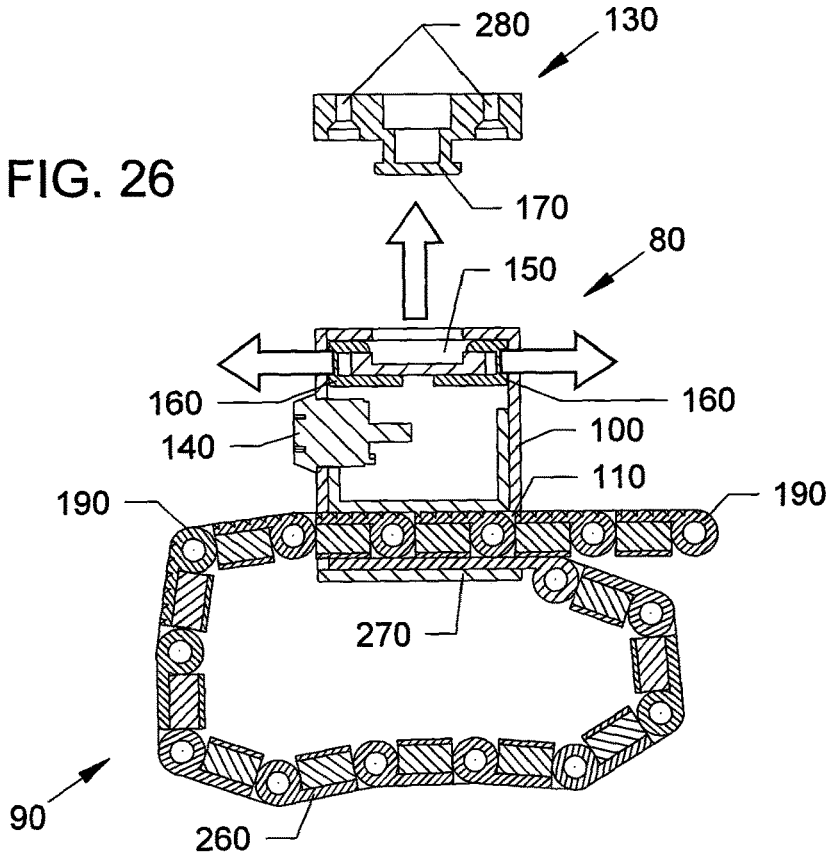
FIG. 26 is a cross-sectional view of the wall mount attachment detached from the lock housing with an opened rectangular clasp releasing the enlarged head of a male member of the wall-mount attachment, the key that controls the clasp and the ratchet belt pulled through the belt cavity of the lock housing are also shown.

FIG. 26 is the same cross-sectional view of the lock housing 80 as shown in FIG. 25; however, FIG. 26 shows the mounting device latch catch 160 moved to an outward position against the walls of the lock housing body 100 thus releasing the mounting device latch 170 from the mounting device latch cavity 150. Thus, by turning the key lock 140, the wall mount attachment 130 is detached from the lock housing 80.

It is to be understood that the third embodiment of this invention is not limited to use on handguns, but is also suitable for use on long guns. FIGS. 27-30, show various views of the pistol trigger lock slide (PTLS) assembly.

Figure 27:
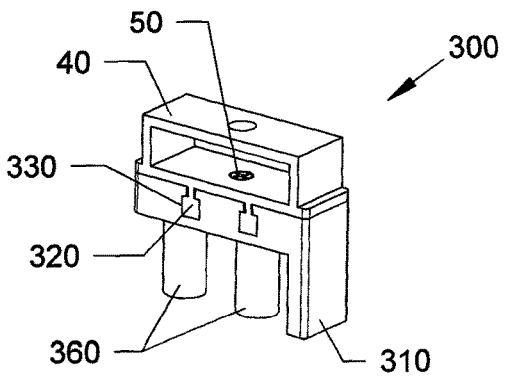
FIG. 27 is a front perspective view of the of the fully assembled pistol trigger lock belt slide assembly (PLTS) of the present invention.

FIG. 27 is a front perspective view of the of the fully assembled pistol trigger lock belt slide assembly (PLTS) 300 of the present invention. The pistol trigger lock 310 has trigger lock guard posts 360 and alignment slots in the trigger lock 330 to receive the alignment key slide rails 320 integrally attached to the ratchet belt cavity 40 held in place with screw 50.

Figure 28:
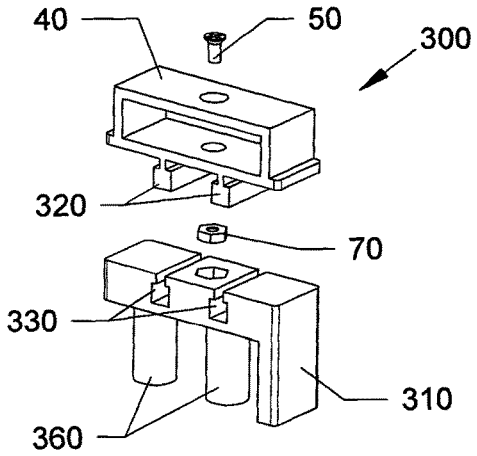
FIG. 28 is an exploded view of the pistol trigger lock belt slide assembly (PLTS) of the present invention showing all parts.

FIG. 28 is an exploded view of the pistol trigger lock belt slide assembly (PLTS) 300 of the present invention showing all parts which include a pistol trigger lock 310, trigger lock guard posts 360, a nut 70 centrally positioned between two parallel alignment slots 330 that receive the alignment key slide rails 320 formed on the underside of the ratchet belt cavity 40 and when fully assembled, the ratchet belt cavity 40 is held in place by screw 50.

Figure 29:
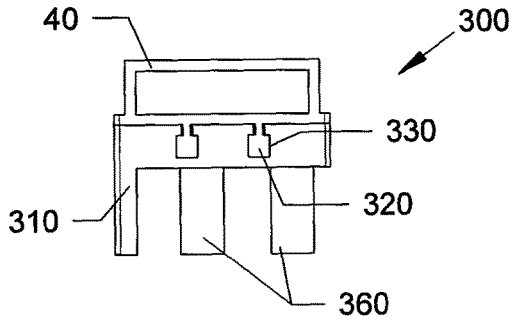
FIG. 29 is a front view of the pistol trigger lock belt slide assembly (PLTS) of the present invention.
Figure 30:
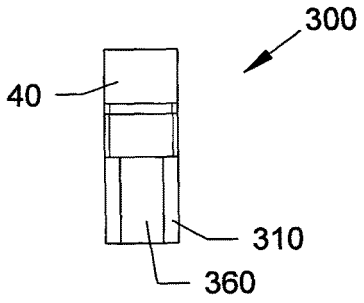
FIG. 30 is a right side view of the pistol trigger lock belt slide assembly (PLTS) of the present invention.
Figure 31:
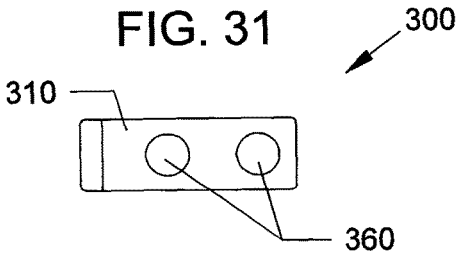
FIG. 31 is a bottom view of the pistol trigger lock belt slide assembly (PLTS) of the present invention.

FIG. 29 is a front view of the pistol trigger lock belt slide assembly (PLTS) 300 of the present invention showing a pistol trigger lock 310, trigger lock guard posts 360, two parallel alignment slots 330 that receive the alignment key slide rails 320 formed on the underside of the ratchet belt cavity 40. FIG. 30 is a right side view of the pistol trigger lock belt slide assembly (PLTS) 300 of the present invention showing a pistol trigger lock 310, trigger lock guard posts 360, and a side edge of the ratchet belt cavity 40. FIG. 31 is a bottom view of the pistol trigger lock belt slide assembly (PLTS) 300 of the present invention showing the bottom sides of a pistol trigger lock 310 and the bottom of the trigger lock guard posts 360.

Figure 33:
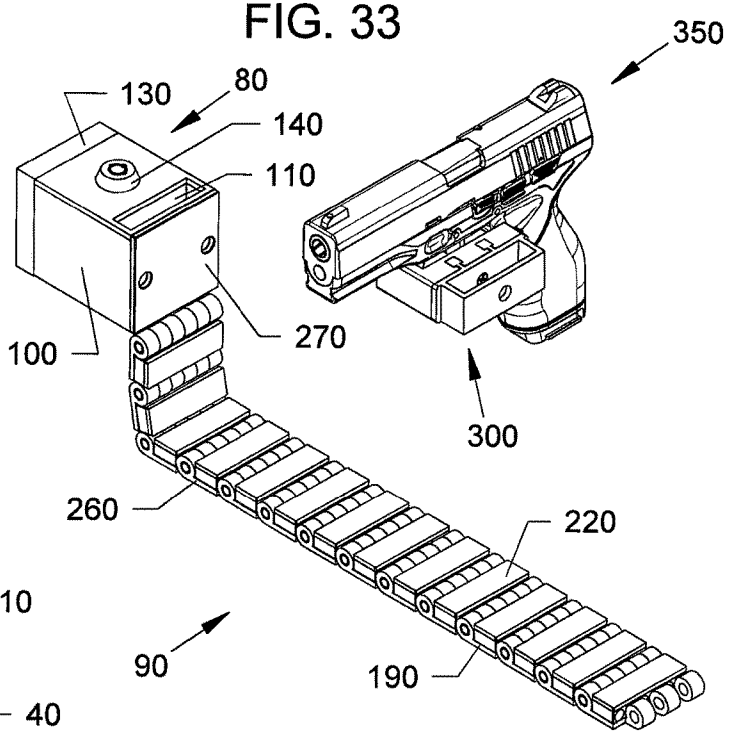
FIG. 33 is a front perspective view of the pistol lock configuration showing the pistol trigger lock engaging the trigger and trigger guard of the pistol before the attachment of the lock housing with attached ratchet belt.
Figure 32:
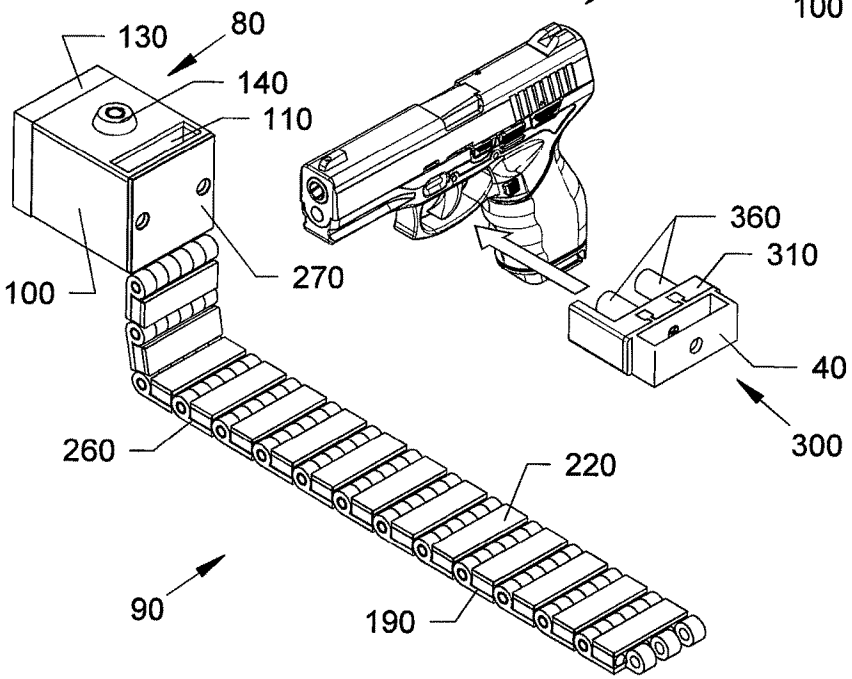
FIG. 32 is a front perspective view of the pistol lock configuration showing the pistol trigger lock assembly in position to engage the trigger and trigger guard of a pistol; the lock housing with attached ratchet belt is included as part of the pistol lock system.
Figures 34, 35, 36:
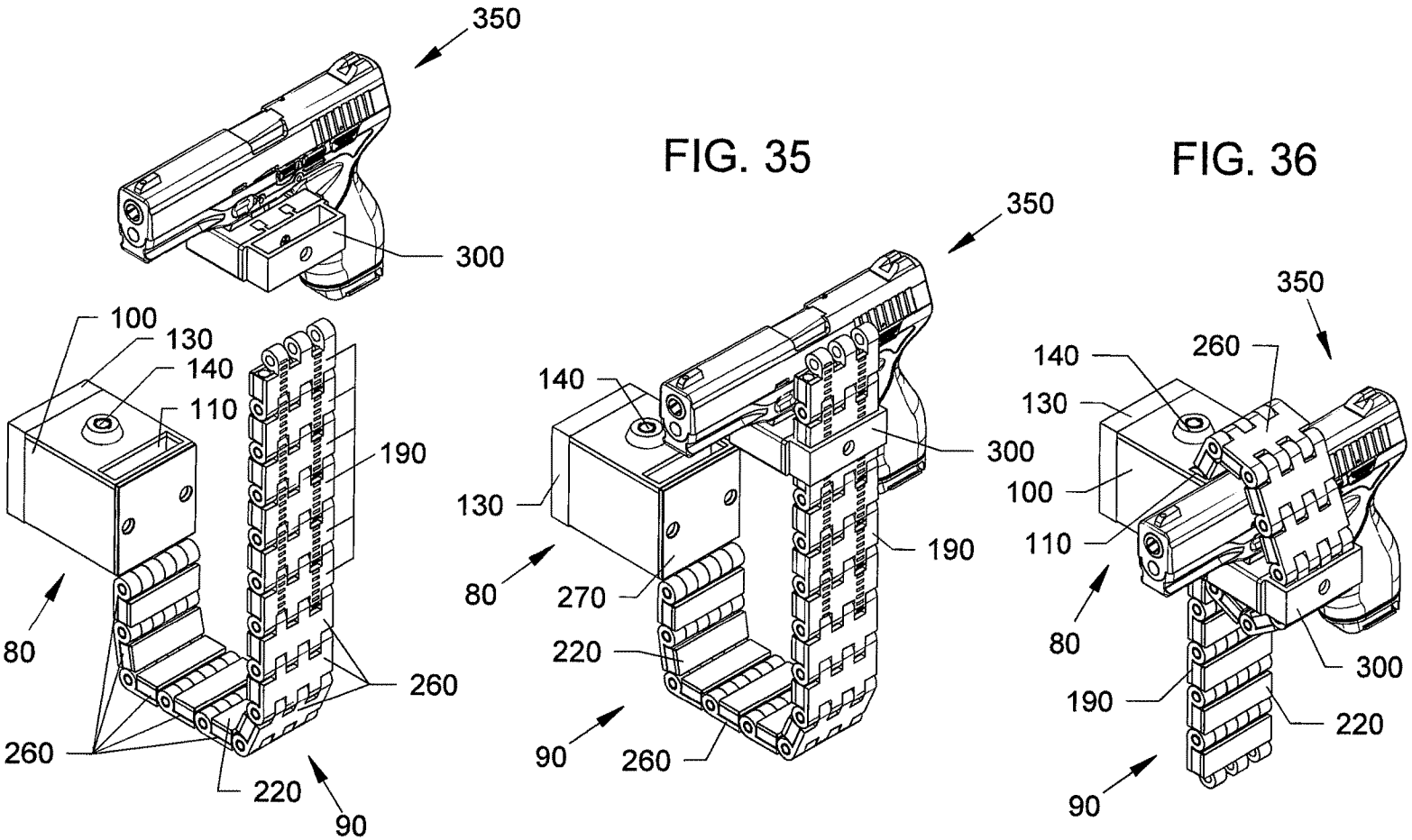
FIG. 34 shows the pistol trigger lock engaging the trigger and trigger guard and the lock housing with attached ratchet belt in position for the ratchet belt to be inserted into the cavity of the pistol trigger lock.
FIG. 35 shows the ratchet belt of the lock housing engaging the cavity of the pistol trigger lock.
FIG. 36 shows the ratchet belt of the lock housing fed through the cavity of the pistol trigger lock and into the belt cavity of the lock housing securing the pistol.

FIGS. 32-33 show the insertion of the trigger lock on a pistol. FIGS. 34-36 show the process for locking or securing a pistol using the lock housing with attached ratchet belt.

FIG. 32 is a front perspective view of the pistol lock configuration showing the pistol trigger lock assembly 300 with pistol trigger lock 310, trigger lock guard posts 360, and ratchet belt cavity 40 in position to engage the trigger and trigger guard of a pistol 350. Included in FIG. 32 as part of the pistol lock system is the lock housing 80 with lock housing body 100, a lock housing belt cavity 110, key lock 140, a mounting device 130, and a flexible lock housing pad 270 attached to ratchet belt 90 comprising a link assembly with ratchet belt catches 190 and a link assembly without ratchet belt catches 260 wherein the link assembly has a flexible link pad 220 on each link and the link assembly with ratchet belt catches 190 is pulled through the belt cavity 110 of the lock housing 80. FIG. 33 shows the same front perspective view of the pistol lock configuration as FIG. 32, wherein the difference in FIG. 33 is that the pistol trigger lock assembly 300 is fully engaging the trigger and trigger guard of the pistol 350 before attachment of the lock housing 80 with attached ratchet belt 90.

FIG. 34 shows the pistol trigger lock assembly 300 engaging the trigger and trigger guard of pistol 350 and the lock housing 80 with lock housing body 100, a lock housing belt cavity 110, key lock 140, a mounting device 130, and a flexible lock housing pad 270 attached to ratchet belt 90 comprising a link assembly with ratchet belt catches 190 and a link assembly without ratchet belt catches 260 wherein the link assembly has a flexible link pad 220 on each link and the link assembly with ratchet belt catches 190 is in position to be pulled through the belt cavity of the pistol trigger lock assembly 300.

FIG. 35 has the same components as FIG. 34 and shows the progressive insertion of the link assembly with ratchet belt catches 190 into the cavity of the pistol trigger lock 300. FIG. 36 completes the locking sequence showing the same components as FIG. 34 with the difference that the ratchet belt 90 of the lock housing 80 has been fed through the cavity of the pistol trigger lock 300 and into the lock housing belt cavity 110 thereby securely locking the pistol 350.

FIGS. 37 and 38 illustrate the use of the locking system of the present invention on a shotgun. FIG. 37 is a front perspective of a shotgun 370 positioned for the lock housing 80 with attached ratchet belt 90 to wrap around the barrel 372 behind the pump handle 374 of a shotgun 370. No slide assembly is used in this configuration.

FIG. 38 is a front perspective of a shotgun 370 wherein the lock housing 80 with mounting device 130 and attached ratchet belt 90 is wrapped around the barrel 372 behind the pump handle 374 of a shotgun 370 and locked with key 120. No slide assembly is used in this configuration.

Locks.

Although a key lock is used in the illustration of the present invention, any suitable locking and disengagement device may be used. Alternatively, for example, FIG. 39 shows lock a housing assembly with a button pad lock 380 and push button lock pad 385. FIG. 40 shows a lock housing assembly with finger print reader locks 400 and finger print reader 405. Any other biometric locking device may be used such as voice or eye recognition. FIG. 41 shows a lock housing assembly with lock housing assembly 390 and barrel combination lock 395.

Although certain embodiments show the lock systems, devices and apparatus only around long guns, the invention can be used with handguns and pistols. For example, the embodiment of FIGS. 1-13 can be used with pistols and handguns having removable magazines. For example, the embodiment of FIGS. 27-36 while shown with triggers on pistols and handguns, can also be used with triggers on long guns, such as rifles and the like. For example, the wall mounts of FIGS. 17-20 for mounting long guns/rifles on support surfaces, can be used to mount pistols and long guns on support surfaces.

Although the embodiments show single applications of the novel lock systems, devices, and apparatus, the invention can be used with a combination of two or more lock housings with attached ratchet belts with or without the non-working magazine slide assembly (NWMS) per weapon.

Alternatively, the embodiments can be used with additional mounting brackets, which can include but are not limited to bent pieces of metal type material that screw or bolt into a surface and further prevents the firearm from movement.

The invention embodiments can be used with or without slide assemblies.

For example, the trigger locking mechanism could be used on a long gun, as illustrated in FIGS. 27-36 in combination with the lock housing with attached ratchet belt on the barrel a pump action shot gun as shown in FIGS. 37-38. Also, for example, two locking devices, apparatus and systems can be used with a single firearm.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of claims here appended.

I claim:

1. A firearm locking system comprising:

an elongated ratchet belt having a first end and a second end, the elongated ratchet belt having a plurality of hinged segments between the first end and the second end of the elongated ratchet belt, wherein each of the hinged segments includes a plurality of links;

a lock housing attached to the first end of the elongated ratchet belt, the lock housing having a through cavity for allowing the second end of the elongated ratchet belt to be inserted and pulled through to different length lock positions; and a locking mechanism for unlocking the different length lock positions of the elongated ratchet belt, wherein the plurality of links have a knuckle on a first end of each link and a knuckle on a second end of each link and the knuckle of one link meshes with the knuckle of an adjoining link and the meshing knuckles are joined by a link pin.

2. The firearm locking system of claim 1, wherein the plurality of hinged segments includes:

a first plurality of segment sections with ratchet belt catches attached to the second end of the elongated ratchet belt;

a link assembly section without ratchet belt catches attached between the first plurality of segment sections and the first end of the elongated ratchet belt, wherein the first plurality of segment sections with ratchet belt catches is pulled through the cavity of the lock housing.

3. The firearm locking system of claim 1, wherein the locking mechanism is selected from one of: a key lock, a biometric lock, and a combination lock.

4. The firearm locking system of claim 1, wherein the firearm includes:

a gun having a trigger, selected from one of a pistol or a handgun or a long gun.

5. A firearm locking system comprising:

an elongated ratchet belt having a first end and a second end, the elongated ratchet belt having a plurality of hinged segments between the first end and the second end of the ratchet belt, wherein the plurality of hinged segments has a first plurality of segment sections with ratchet belt catches attached to the second end of the elongated ratchet belt;

a lock housing attached to the first end of the elongated ratchet belt, the lock housing having a through cavity for allowing the second end of the elongated ratchet belt to be inserted and pulled through to different length lock positions, wherein the first plurality of segment sections with ratchet belt catches is pulled through the cavity of the lock housing; and a locking mechanism for unlocking the different length positions of the elongated ratchet belt.

6. The firearm locking system of claim 5, further comprising:

a link assembly section without ratchet belt catches attached between the first plurality of segment sections and the first end of the elongated ratchet belt.

7. The firearm locking system of claim 5, wherein the locking mechanism is selected from one of: a key lock, a biometric lock, and a combination lock.

8. The firearm locking system of claim 5, wherein the firearm includes:

a gun having a trigger, selected from one of a pistol or a handgun or a long gun.

9. A firearm locking system comprising:

an elongated ratchet belt having a first end and a second end;

a lock housing attached to the first end of the elongated ratchet belt, the lock housing having a through cavity for allowing the second end of the elongated ratchet belt to be inserted and pulled through to different length lock positions; and a locking mechanism for unlocking the different length positions of the elongated ratchet belt;

a mount for attaching the lock housing to a support surface, the mount having a first side and a second side, the first side being attached to the support surface, the second side being attached to the lock housing; and a mount mechanism having an outwardly protruding fixed latch which mounts to a latch cavity with a movable latch catch, the mount mechanism having an unlock position and a lock position, wherein the mount prevents the lock housing from being removed from the first side of the mount when the fixed latch is inside of the latch cavity and the moveable latch catch has engaged the fixed latch with the moveable latch being in the lock position, and the lock housing being removeable from the first side of the mount when the moveable latch catch is disengaged from the fixed latch.

10. The firearm firearm locking system of claim 9, further comprises:

a non-working magazine that replaces a working magazine that is used for a firearm, wherein the non-working magazine is locked into a magazine slot in the firearm by the elongated ratchet belt.

11. The firearm locking system of claim 9, further comprising:

a trigger lock for locking a trigger on the firearm in a nonfire position, the trigger lock being held in place by the elongated ratchet belt.

12. The firearm locking system of claim 11, wherein the trigger lock includes:

protruding members for passing about the trigger on the firearm; and a through slot for allowing the second end of the elongated ratchet belt to be pulled through.

13. The firearm locking system of claim 9, wherein the locking mechanism includes:

a key lock.

14. The firearm locking system of claim 9, wherein the locking mechanism includes:

a biometric lock.

15. The firearm locking system of claim 9, wherein the locking mechanism includes:

a combination lock.

16. The firearm locking system of claim 9, wherein the firearm includes:

a gun having a trigger, selected from one of a pistol or a handgun or a long gun.

17. The firearm locking system of claim 9, wherein the firearm includes:

a gun having a replaceable magazine, selected from one of a machine gun and a pistol.

18. The firearm locking system of claim 9, wherein the firearm includes:

a pump action shot gun.

19. The firearm locking system of claim 9, wherein the lock housing further comprises:

a rotatable member for moving the movable latch catch from the unlock position to the lock position, and back to the unlock position.

20. The firearm locking system of claim 9, wherein the outwardly protruding fixed latch includes an enlarged head having perimeter edges that extend over a narrower diameter neck portion.

* * * * *